US005584206A

United States Patent [19]

Ohta

[11] Patent Number: 5,584,206

[45] Date of Patent: Dec. 17, 1996

[54] ELECTRIC ACTUATOR

[75] Inventor: Satoshi Ohta, Kosai, Japan

[73] Assignee: Asmo Co., Ltd., Japan

[21] Appl. No.: 580,526

[22] Filed: Dec. 28, 1995

Related U.S. Application Data

[62] Division of Ser. No. 276,162, Jul. 14, 1994, Pat. No. 5,526,710.

[30] Foreign Application Priority Data

| | | | |
|---|---|---|---|
| Jul. 16, 1993 | [JP] | Japan | 5-39097 |
| Jul. 16, 1993 | [JP] | Japan | 5-39098 |
| Jan. 31, 1994 | [JP] | Japan | 6-9989 |

[51] Int. Cl.[6] ..... E05B 65/20

[52] U.S. Cl. ..... 74/89; 70/277; 74/99 A; 292/144; 292/201; 292/DIG. 23

[58] Field of Search ..... 74/89, 99 A; 292/142, 292/144, 199, 201, DIG. 23; 70/190, 275, 277, 280

[56] References Cited

U.S. PATENT DOCUMENTS

| | | | |
|---|---|---|---|
| 4,518,181 | 5/1985 | Yamada | 292/201 |
| 4,669,283 | 6/1987 | Ingenhoven | 292/144 |
| 4,723,454 | 2/1988 | Periou et al. | 292/201 |
| 4,941,694 | 7/1990 | Bartel et al. | 292/201 |
| 4,978,155 | 12/1990 | Kobayashi | 292/201 |

FOREIGN PATENT DOCUMENTS

| | | | |
|---|---|---|---|
| 16436 | 6/1990 | Japan . | |
| 25590 | 12/1991 | Japan . | |
| 362362 | 6/1992 | Japan . | |
| 131557 | 7/1992 | Japan . | |
| 2218729 | 11/1989 | United Kingdom | 70/277 |

*Primary Examiner*—Charles A. Marmor
*Assistant Examiner*—Troy Grabow
*Attorney, Agent, or Firm*—Stetina Brunda & Buyan

[57] ABSTRACT

An actuator is disclosed, which comprises a drive motor, a rotary member to be rotated by the drive motor, and a plunger for reciprocating in its axial direction. The plunger has a first and second guide portions formed thereon. The actuator further comprises a guiding member held in the rotary member. The guiding member includes a first spiral guide surface for guiding the first guide portion therealong to move the plunger in a direction to protrude it, a second spiral guide surface for guiding the second guide portion therealong to move the plunger in a direction to retract it, a first position regulating surface for regulating the retraction of the plunger when it contacts with the first guide portion, and a second position regulating surface for regulating the protrusion of the plunger when it contacts with the second guide portion.

5 Claims, 33 Drawing Sheets

ELECTRIC ACTUATOR

This application is a division of application Ser. No. 08/276,162, filed Jul. 14, 1994, U.S. Pat. No. 5,526,710.

BACKGROUND OF THE INVENTION

1. Field of the Invention

The present invention relates to an electric actuator and, more particularly, to an electric actuator equipped with a retractable plunger that can protrude from and retract into the body of the actuator.

2. Description of the Related Art

As is generally the case, the conventional motorized vehicle 100, as shown in FIG. 1, has a door 101 equipped with a locking device 102. This locking device 102 locks the door 101 in a closed position. A door handle 103, attached to the inner panel of the door 101, allows the vehicle's operator to both open and lock the door 101 by disengaging and engaging the locking device 102. It is also generally the case that the locking device 102 comes equipped with a locking mechanism to prevent the locking device 102 from being operated despite the operation of the door handle 103. A knob 106, connected to the locking mechanism by a lever 105, allows the vehicle's operator to engage or disengage the locking mechanism. When the knob 106 is pulled up or down, the locking mechanism in the locking device 102 can be operated through the lever 105. When the knob 106 is lowered, the locking device 102 engages the locking mechanism in a locked state to prevent the door from opening even if the door handle 103 is manipulated. When the knob 106 is raised from a lowered position, the locking mechanism is disengaging allowing the door to be opened by operation of the door handle 103.

An electric actuator 107 is incorporated inside the door 101, and connects to the locking device 102 via the lever 105. As shown in FIG. 2, the electric actuator 107 is coupled to a safe lock switch 109 and a vehicle speed sensor 110 via an electric control unit (i.e., ECU) 108 provided with the vehicle 100. The safe lock switch 109, disposed in the door 101, and the vehicle speed sensor 110 are electrically coupled with the locking device 102.

When the vehicle 100 is operated at a predetermined speed with unlocked doors (i.e., in the unlock state of the locking device 102), the ECU 108 operates the electric actuator 107 in response to a signal generated by the vehicle speed sensor 110. In such a case, the electric actuator 107 causes knob 106 to be placed in a lowered or depressed position. The actuator 107 thus causes the locking mechanism to secure the door 101 in a locked state. In other words, the electric actuator 107 pulls down the knob 106 and actuates the locking mechanism in the locking device 102 through the lever 105. Thus, the locking device 102 comes into the lock state in which the door 101 cannot be opened even if the door handle 103 is operated.

When the safe lock switch 109 is operated by a vehicle's operator, with the device 102 in the lock state, for the purpose of opening the door, the ECU 108 operates the electric actuator 107 to pull up the knob 106 and brings the locking device 102 into the unlock state, in which the door 101 can be opened if the door handle 103 is operated. On the other hand, when the safe lock switch 109 is operated by the vehicle's operator with the device 102 in the unlock state, the ECU 108 operates the electric actuator 107 and actuates the locking mechanism in the locking device 102 through the lever 105. Thus, the locking mechanism is forcibly operated independently of the vehicle speed to establish the lock state, in which the door 100 cannot be opened even if the door handle 103 is operated.

In addition to the above operation, the locking mechanism can also be manually operated by a vehicle passenger by physically manipulating the knob 106 up or down to respectively lock or unlock the door 101 (i.e., to bring the locking mechanism into the lock state or unlock state).

An Examined Japanese Patent Publication No. 3-25590 discloses a traditional electric actuator for switching the locking device 102 between the lock state and unlock state. This electric actuator comprises a rotary disc having a cam groove and a cam follower lever provided with a cylindrical cam follower. As the rotary disc is rotated clockwise by a drive motor, the cam follower slides along the cam groove of the rotary disc. When the cam follower comes into contact with a first abutting portion formed in the cam groove to define a locking position, the rotation of the rotary disc is regulated. Then, the cam follower lever operates the locking device to bring the door into the lock state. On the other hand, when the rotary disc is rotated counter-clockwise, this causes the cam follower to contact with a second abutting portion formed in the cam groove to define an unlocking position. Consequently, its rotation is regulated, and the cam follower lever operates the locking device to bring the door into the unlock state.

The cam follower lever in the conventional actuator, however, utilizes only one cam follower. Each time the single cam follower slides along the cam groove, it comes into collision against the inner walls of the cam groove at the first and second abutting portions. In addition, the cam follower is always in sliding contact with the cam groove. As a result, the cam follower is subject to being seriously worn.

Moreover, since the cam follower is formed with a cylindrical shape, the abutment between the follower and the first or second abutting portions in the cam groove results in line-contact. As a result, an impact is always applied to specific portions of the cam follower, lowering the durability of the cam follower. These types of actuators also require relatively large numbers of component parts. This makes their manufacture and assembly relatively complex and difficult.

In the conventional actuator, moreover, a force may be applied to an engaging projection of a lock lever through a fork member connected to the knob, when the actuator is manually operated. At this time, the cam follower lever is turned by an intermediate lever connecting the cam follower lever with a lock lever. As the cam follower lever is turned, the cam follower linearly moves along a linear groove joining the first abutting portion with the second abutting portion. Unless the cam follower is disposed in the linear joining groove, however, the locking device cannot be manually operated in response to the manual operation of the knob.

SUMMARY OF THE INVENTION

Accordingly, it is a primary objective of the present invention to provide an electric actuator which has an excellent durability and which is capable of reliably engaging the locking device when manually operated.

It is further object of the present invention to provide an electric actuator that requires a relatively small number of component parts so as to facilitate its assembly.

To achieve the foregoing and other objects and in accordance with the purpose of the present invention, an improved actuator is provided.

The first type of the actuator according to the present invention comprises a drive motor, a rotary member to be rotated clockwise and counter-clockwise by the drive motor, and a plunger for reciprocating in its axial direction, a portion of which protrudes outside the actuator. The plunger has a first and second guide portions formed thereon. The actuator further comprises a guiding member held in the rotary member. The guiding member includes a first spiral guide surface for guiding the first guide portion therealong to move the plunger in a direction to protrude it, a second spiral guide surface for guiding the second guide portion therealong to move the plunger in a direction to retract it, a first position regulating surface for regulating the retraction of the plunger when it contacts with the first guide portion, and a second position regulating surface for regulating the protrusion of the plunger when it contacts with the second guide portion.

The second type of the actuator according to the present invention comprises a drive motor, a rotary member to be rotated clockwise and counter-clockwise by the drive motor, and a plunger for reciprocating in its axial direction, a portion of which protrudes outside the actuator. A cylindrical supporting member is held in the rotary member, and is capable of receiving the plunger. The supporting member has a first and second guide portions formed on its inner circumference. The actuator further comprises a leading member fixed on the plunger. The leading member includes a first spiral guide surface for guiding the first guide portion therealong to move the plunger in a direction to retract it, a second spiral guide surface for guiding the second guide portion therealong to move the plunger in a direction to protrude it, a first position regulating surface for regulating the retraction of the plunger when it contacts with the second guide portion, and a second position regulating surface for regulating the protrusion of the plunger when it contacts with the first guide portion.

The third type of the actuator according to the present invention comprises a casing, a drive motor, and a plunger for reciprocating in its axial direction, a portion of which protrudes outside the actuator. A rotary member is rotated clockwise and counter-clockwise by the drive motor, and includes a support sleeve into which the plunger is inserted. The support sleeve has a first and second movement guiding portions formed on its inner circumference. A spiral leading member is fixed on the plunger. The leading member includes a first and second spiral guide surfaces capable of contacting with the first and second movement guiding portions, respectively, a first regulation surface formed at a first tip end of the leading member, for contacting with the first movement guiding portion to regulate the rotation of the rotary member, and a second regulation surface formed at a second tip end of the leading member, for contacting with the second movement guiding portion to regulate the rotation of the rotary member. The first and second movement guiding portions are disposed on an inner circumference of the support sleeve, in such a manner that the second movement guiding portion has no interference with the second tip end of the leading member even when the plunger reciprocates with the first movement guiding portion being in contact with the first regulation surface of the leading member, and that the first movement guiding portion has no interference with the first tip end of the leading member even when the plunger reciprocates with the second movement guiding portion being in contact with the second regulation surface of the leading member.

The fourth type of the actuator according to the present invention comprises a casing, a drive motor, and a cylindrical plunger for reciprocating in its axial direction, a portion of which protrudes outside the actuator. A rotary member is rotated clockwise and counter-clockwise by the drive motor, a portion of which is inserted into the cylindrical plunger. The rotary member has a first and second movement guiding portions formed thereon. A spiral leading member is fixed on an inner circumference of the cylindrical plunger. The leading member includes a first and second spiral guide surfaces capable of contacting with the first and second movement guiding portions, respectively, a first regulation surface formed at a first tip end of the leading member, for contacting with the first movement guiding portion to regulate the rotation of the rotary member, and a second regulation surface formed at a second tip end of the leading member, for contacting with the second movement guiding portion to regulate the rotation of the rotary member. The first and second movement guiding portions are arranged on an outer circumference of the rotary member, in such a manner that the second movement guiding portion has no interference with the second tip end of the leading member even when the plunger reciprocates with the first movement guiding portion being in contact with the first regulation surface of the leading member, and that the first movement guiding portion has no interference with the first tip end of the leading member even when the plunger reciprocates with the second movement guiding portion being in contact with the second regulation surface of the leading member.

BRIEF DESCRIPTION OF THE DRAWINGS

The features of the present invention that are believed to be novel are set forth particularly in the appended claims. The invention, together with the objects and advantages thereof, may best be understood by reference to the following description of the presently preferred embodiments together with the accompanying drawings.

FIGS. 3 to 10 shows a first embodiment of the present invention, wherein:

FIG. 3 is a longitudinal section of an electric actuator shown together with a locking device;

FIG. 4 is a diagram illustrating the engagement between a plunger and a guiding member when the guiding member makes a clockwise rotation around the plunger;

FIG. 5 is a diagram illustrating the regulation of the plunger's movement by the guide pin's contact with the guiding member;

FIG. 6 is a diagram illustrating the plunger's movement out of the actuator by the counter-clockwise rotation of the guiding member;

FIG. 7 is a front elevation showing the state in which the guiding member is fitted in a rotary gear;

FIG. 8 is front elevation of the guiding member;

FIG. 9 is a longitudinal section of the plunger; and

FIG. 10 is a front elevation of the guide pin of FIG. 9.

FIGS. 11 to 18 shows a second embodiment of the present invention, wherein:

FIG. 11 is a longitudinal section showing an electric actuator;

FIG. 12 is a diagram showing a plunger and a guiding member of FIG. 11 and illustrates how the intrusion of the plunger is regulated by the contact of a guide pin with a regulating surface of the guiding member;

FIG. 13 is a diagram showing the plunger and the guiding member of FIG. 11 and illustrates how the plunger is protruded by a clockwise rotation of the guiding member;

FIG. 14 is a diagram showing the plunger and the guiding member of FIG. 11 and illustrates how the protrusion of the plunger is regulated by the contact of the guide pin with an another regulating surface of the guiding member;

FIG. 15 is a diagram showing the plunger and the guiding member of FIG. 11 and illustrates how the plunger is intruded by a counter-clockwise rotation of the guiding member;

FIG. 16 is a diagram showing the guiding member; and

FIG. 17 is a diagram showing a rotary shaft having the guiding member fitted thereon;

FIG. 18 is a front elevation showing the plunger.

FIGS. 19 to 25 shows a third embodiment of the present invention, wherein:

FIG. 19 is a longitudinal section showing an electric actuator;

FIG. 20 is a front elevation showing a supporting member for a rotary gear shown in FIG. 19;

FIG. 21 shows how the intrusion of a plunger is regulated by the contact of a guide pin with a regulating surface;

FIG. 22 shows how the plunger is protruded by a counter-clockwise rotation of the supporting member together with the guide pin;

FIG. 23 shows how the protrusion of the plunger is regulated by the contact of the guide pin with an another regulating surface;

FIG. 24 shows how the plunger is intruded by a clockwise rotation of the supporting member together with the guide pin; and FIG. 25 is a front elevation showing the guiding member fitted on the plunger.

FIGS. 26 to 35 shows a fourth embodiment of the present invention, wherein:

FIG. 26 is a diagram showing the inside of an electric actuator;

FIG. 27 is a diagram showing how an enlarged slit is formed of two slits;

FIG. 28 is a diagram showing the state in which the plunger is slightly moved upward from the lowermost position;

FIG. 29 is a diagram showing the state in which the plunger is disposed in the uppermost position;

FIG. 30 is a diagram showing the state in which the plunger is slightly moved downward from the uppermost position;

FIG. 31 is a front elevation showing the positional relationship between a guide pin and the guiding member contacting with a lower guide pin;

FIG. 32 is a front elevation showing the positional relationship between the guide pin and the guiding member slightly apart from the lower guide pin;

FIG. 33 is a front elevation showing the positional relationship between the guide pin and the guiding member;

FIG. 34 is a perspective section showing the inside of a rotary gear and supporting sleeves integrated with the gear; and FIG. 35 is an expansion showing the inner circumferences of the supporting sleeves shown in FIG. 34.

FIGS. 36 to 41 shows a fifth embodiment of the present invention, wherein:

FIG. 36 is a diagram showing the inside of an electric actuator;

FIG. 37 is a partially exploded perspective view showing a structure for regulating the vertical movements of the plunger;

FIG. 38 is a diagram showing the state in which the plunger is slightly moved upward from the lowermost position;

FIG. 39 is a diagram showing the state in which the plunger is disposed in the uppermost position;

FIG. 40 is a diagram showing the state in which the plunger is slightly moved downward from the uppermost position; and FIG. 41 is a front elevation showing the construction of a rotary gear and a rotary shaft.

FIGS. 42 to 48 shows a sixth embodiment of the present invention, wherein:

FIG. 42 is a longitudinal section showing an electric actuator;

FIG. 43 is a partially cut-away perspective view showing the engagement between a guide groove formed in the plunger and a guide pin formed on a rotary gear;

FIG. 44 is a front elevation showing the plunger;

FIG. 45 is a front elevation showing the guide pin formed on the inner circumference of the rotary gear;

FIG. 46 is a diagram showing the plunger which is disposed in the lowermost position;

FIG. 47 is a diagram showing the plunger which is disposed in the uppermost position; and FIG. 48 is a perspective view showing an another example of the plunger.

DETAILED DESCRIPTION OF THE PREFERRED EMBODIMENTS

The present invention will be described in the following in connection with its first to sixth embodiments.

First Embodiment

Figure 3:
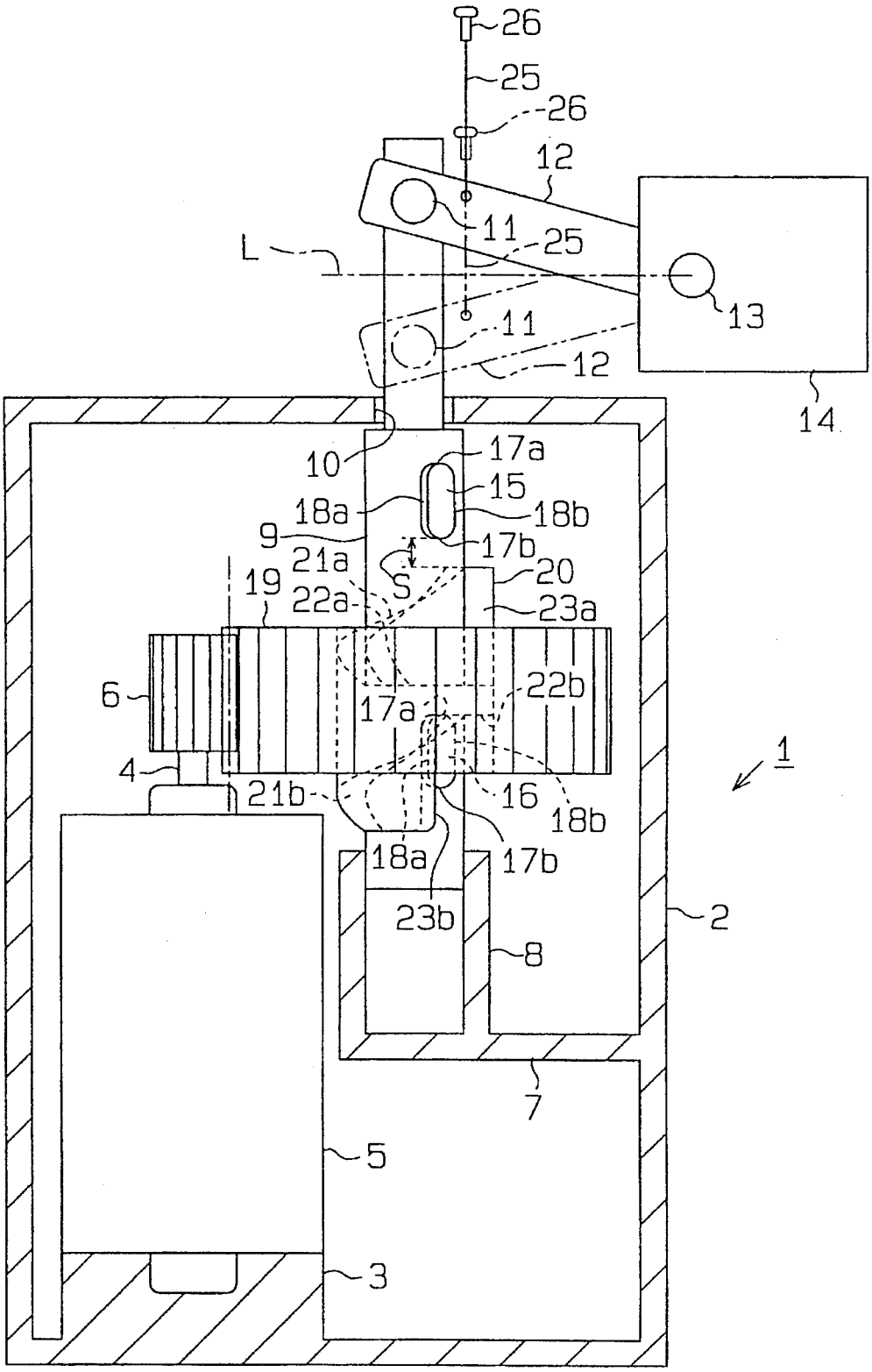

With reference to FIGS. 3 to 10, the first embodiment will be described in connection with an electric actuator for actuating a vehicular door locking device. As shown in FIG. 3, the electric actuator 1 includes a box shaped casing 2 formed of a resin. A bed 3, formed on the bottom of the casing 2, supports a drive motor 5 having a drive shaft 4 extending upward therefrom. The drive shaft 4 attaches to a pinion 6 made of resin, at the drive shaft's leading edge.

At the righthand side of the bed 3, a support wall 7 extends from the inner side of the casing 2, and is integrated with a sleeve portion 8 extending upward from the support wall 7. The lower end of a plunger 9 is slidably received in the sleeve portion 8, to allow for its up and down vertical movement relative to the actuator 1. The plunger 9 has a leading end extending outside the actuator 1 through a bore 10 formed in the upper portion of the casing 2.

The leading end of the plunger 9 is connected, via a connecting pin 11, to the leading end of a lever 12 made of a resin. This lever 12 has its base end connected to a locking device 14 by means of a pivot 13. As the plunger 9 is actuated to extend and retract from the upper face of the casing 2, the lever 12 pivots on the pivot 13.

Figure 1:
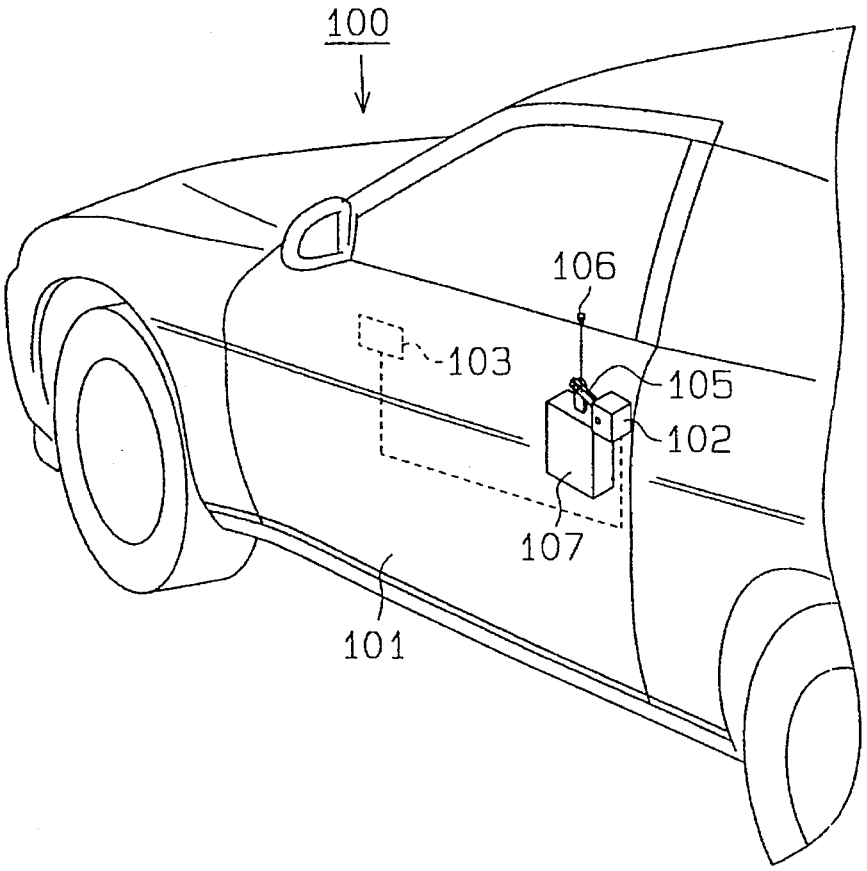
FIG. 1 is a schematic diagram showing an electric actuator and a locking device which are mounted in a door of a vehicle.
Figure 2:
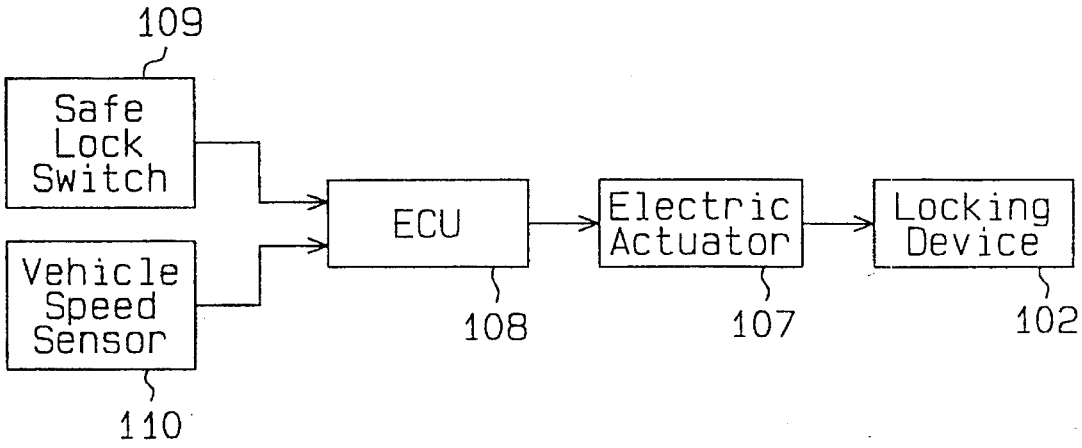
FIG. 2 is a block diagram of a circuit for operating the door locking device.

When the lever 12 is located at a position above a horizontal line L extending through the pivot 13, the locking device 14 takes an unlock state, in which the door 101 can be freely opened by the manipulation of the door handle 103 as shown in FIG. 1. Alternatively, when the lever 12 is located at a position below the horizontal line L, the locking device 14 takes a lock state, in which the door 100 cannot be opened even if the door handle 103 is manipulated.

With the upward movement of the lever 12 across the horizontal line L, the plunger 9 and the lever 12 are forcibly moved to the uppermost position, as indicated by solid lines in FIG. 3, by the action of a spring (not shown) disposed in the locking device 14. Then, this locking device 14 comes into the unlock state in which the door 101 can be opened by the manipulation of the door handle 103. With the downward movement of the lever 12 beneath the horizontal line L, on the other hand, the plunger 9 and the lever 12 are forcibly moved to their lowermost position, as indicated by double-dotted lines, by the action of the spring in the locking device 14. Then, this locking device 14 comes into the lock state, in which the door 101 is prevented from being opened by the manipulation of the door handle 103.

The lever 12 is connected via a rod 25 to a knob 26 (similar to the knob 106 in FIG. 1). Manual up or down manipulation of the knob 26 causes the locking device 14 to take the lock or unlock state.

Figure 9:
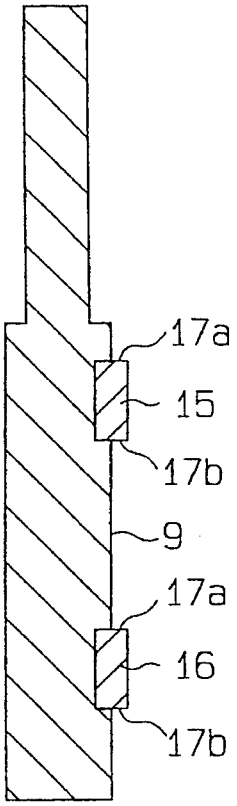
Figure 10:
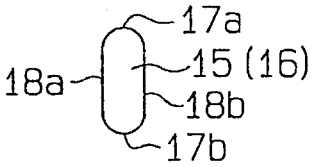

A first and second metal guide pins 15 and 16, as a first and second guide members, fit into the outer circumferential surface of the plunger 9, as shown in FIG. 9. These individual guide pins 15 and 16 are elliptically formed, as shown in FIG. 10, to have arcuate contact-sliding portions 17*a* and 17*b* at their upper and lower most portions as well as straight contact surfaces 18*a* and 18*b* at their right and lefthand portions.

As shown in FIG. 3, the pinion 6 is engaged with a rotary gear 19 made of a resin. A guiding member 20, made of a resin, is fixed on the center portion of the rotary gear 19, and is formed into a generally cylindrical shape. The plunger 9 is inserted into the guiding member 20.

Figure 8:
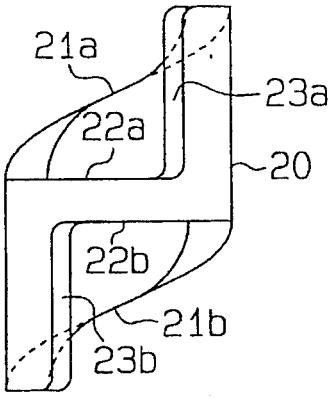

As shown in FIG. 8, the guiding member 20 has a spiral first guide surface 21*a* formed on a portion of its upper end portion, and a spiral second guide surface 21*b* formed on a portion of its lower end portion. The first guide surface 21*a* couples with a first flat surface 22*a* and a first position regulating surface 23*a*, which are formed on the guiding member 20. The second guide surface 21*b* couples with a second flat surface 22*b* and a second position regulating surface 23*b*, which are formed on the guiding member 20.

When the contact-sliding portion 17*a* of the lower guide pin 16 of the plunger 9 comes into contact with the flat surface 22*b* and when the contact surface 18*a* of the guide pin 16 comes into contact with the position regulating surface 23*b*, as shown in FIG. 3, the protrusion of the plunger 9 outside the casing 2 is regulated. At this time, a space S is formed between the contact-sliding portion 17*b* of the upper guide pin 15 and the guiding member 20, and allows an erection tolerance in assembling the actuator.

With the arrangement as shown in FIG. 3, when the rotary gear 19 and the guiding member 20 are rotated clockwise by the drive motor 5, the contact-sliding portion 17*a* of the guide pin 16 slides through the flat face 22*b* along the guide surface 21*b*. Then, the plunger 9 is retracted into the casing 2. In the case where the lever 12 is not located below the horizontal line L, the guide pin 15 is away from the guiding member 20, due to the space S. When the lever 12 is located below the horizontal line L, the plunger 9 is urged downward by the action of the spring in the locking device 14 so that the contact-sliding portion 17*b* of the upper guide pin 15 can come into contact with the upper end of the guiding member 20 to slide on the surface of the guiding member 20. Then, the lower guide pin 16 leaves the lower end of the guiding member 20 to establish the space S therebetween.

Figure 5:
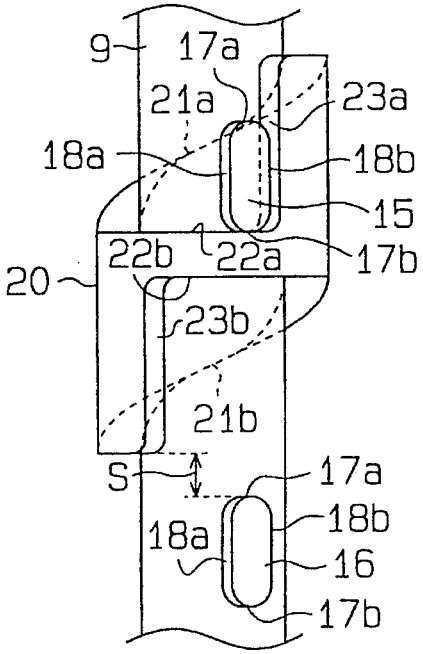

When the contact surface 18*b* of the upper guide pin 15 comes into contact with the first position regulating face 23*a* of the guiding member 20, as shown in FIG. 5, not only the retraction of the plunger 9 into the casing 2 but also the rotation of the rotary gear 19 is regulated so that the drive of the motor 5 is interrupted. Consequently, the plunger 9 comes into the casing 2 so that the lever 12 is located at the position as indicated by the double-dotted lines in FIG. 3. At this time, the locking mechanism in the locking device 14 comes into the lock state, in which the door 101 cannot be opened by the manipulation of the door handle 103.

Figure 6:
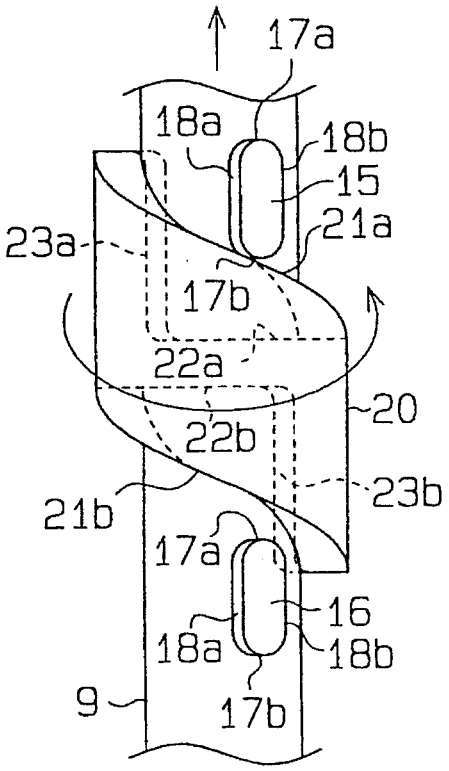
Figure 7:
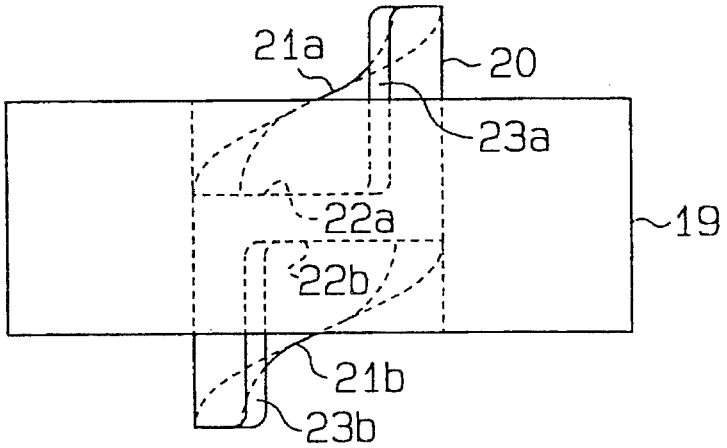

With the arrangement as shown in FIG. 5, when the rotary gear 19 and the guiding member 20 are rotated counter-clockwise by the drive motor 5, the contact-sliding portion 17*b* of the upper guide pin 15 slides through the flat surface 22*a* along the guide surface 21*a*, as shown in FIG. 6. Then, the plunger 9 is moved upward out of the casing 2. In case the lever 12 is not located above the horizontal line L, the lower guide pin 16 is away from the guiding member 20 due to the space S. When the lever 12 is located above the horizontal line L, the plunger 9 is urged upward by the action of the spring in the locking device 14 so that the contact-sliding portion 17*a* of the lower guide pin 16 can come into contact with the lower end of the guiding member 20 to slide on the surface of the guiding member 20. Then, the upper guide pin 15 leaves the upper end of the guiding member 20 to form the space S therebetween.

When the contact surface 18*a* of the lower guide pin 16 comes into contact with the second position regulating surface 23*b* of the guiding member 20, as shown in FIG. 3, not only the movement of the plunger 9 but also the rotation of the rotary gear 19 is regulated so that the drive of the motor 5 is interrupted. Thus, the plunger 9 is protruded from the casing 2 so that the lever 12 is located at the position as shown by the solid lines. At this time, the locking mechanism in the locking device 14 comes into the unlock state, in which the door 101 can be opened by the manipulation of the door handle 103.

Also by manual manipulation of the knob 26 provided in the inner wall of the door 101, the plunger 9 can be vertically moved. In other words, the locking device 14 can be set in the lock or unlock state at any time by a passenger of the vehicle. Also in this case, the guiding member 20 has no interference with the guide pins 15 and 16 of the plunger 9 to allow the knob 26 to be manually operated.

Next, the operations of the electric actuator according to this embodiment will be described. When the lever 12 is located above the horizontal line L, as shown in FIG. 3, the plunger 9 is urged upward by the action of the spring in the locking device 14. At this time, the contact-sliding portion 17*a* of the lower guide pin 16 is in contact with the flat surface 22*b* of the guiding member 20, and the contact surface 18*a* of the guide pin 16 is in contact with the second position regulating surface 23*b* of the guiding member 20. The locking device 14 is in the unlock state, in which the door 101 can be opened by the manipulation of the door handle 103.

Figure 4:
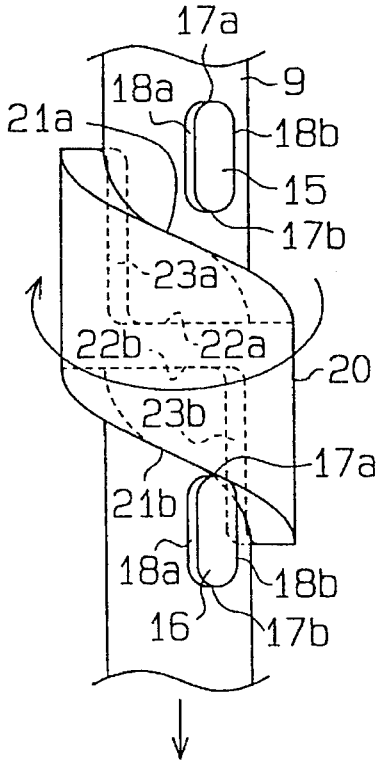

With the arrangement as shown in FIG. 3, when the rotary gear 19 and the guiding member 20 are rotated clockwise by the drive motor 5, the contact-sliding portion 17*a* of the lower guide pin 16 slides through the flat surface 22*b* along the guide surface 21*b*, as shown in FIG. 4. In accordance with these rotations, the plunger 9 comes into the casing 2. The upper guide pin 15 will not come into contact with the upper surface of the guiding member 20 till the lever 12 is brought across the horizontal line L to the lowermost position. When the lever 12 is located below the horizontal line L, the plunger 9 urged downward by the action of the spring in the locking device 14. Then, the contact-sliding portion 17*b* of the upper guide pin 15 comes into contact with the upper surface of the guiding member 20 to form the space S between the lower guide pin 16 and the lower surface of the guiding member 20.

As the rotary gear 19 and the guiding member 20 further rotate clockwise, the contact-sliding portion 17*b* of the upper guide pin 15 slide on the flat surface 22*a*, until the contact surface 18*b* of the guide pin 15 comes into contact with the first position regulating surface 23*a*, as shown in FIG. 5. At this time, the retraction of the plunger 9 into the casing 2 is inhibited to regulate the rotation of the rotary gear 19. Consequently, the drive of the motor 5 is interrupted. Thus, the lever 12 is located at the position as indicated by the double-dotted lines in FIG. 3, so that the locking mechanism of the locking device 14 is brought into the lock state, in which the door 101 cannot be opened by the manipulation of the door handle 103.

With the arrangement as shown in FIG. 5, when the rotary gear 19 and the guiding member 20 are rotated counter-clockwise, the contact-sliding portion 17*b* of the upper guide pin 15 slides through the flat surface 22*a* along the guide surface 21*a*, as shown in FIG. 6. In accordance with these rotations, the plunger 9 is protruded outside the casing 2. Moreover, the lower guide pin 16 does not come into contact with the lower surface of the guiding member 20 so long as the lever 12 does not go over the horizontal line L to the uppermost position. When the lever 12 is located above the horizontal line L, the plunger 9 is urged upward by the action of the spring in the locking device 14. Then, the contact-sliding portion 17*a* of the lower guide pin 16 comes into contact with the lower surface of the guiding member 20, thus forming the space S between the upper guide pin 15 and the guiding member 20.

When the rotary gear 19 and the guiding member 20 are further rotated counter-clockwise, the contact-sliding portion 17*a* of the lower guide pin 16 slides on the flat surface 22*b*, and the contact surface 18*a* of the guide pin 16 comes into contact with the second position regulating surface 23*b* of the guiding member 20, as shown in FIG. 3. At this time, the protrusion of the plunger 9 from the casing 2 is inhibited to regulate the rotation of the rotary gear 19. Consequently, the drive of the motor 5 is interrupted. Thus, the lever 12 is located at the position as indicated by the solid lines, so that the locking mechanism of the locking device 14 comes into the unlock state, in which the door 101 can be opened by the manipulation of the door handle 103.

In this embodiment, when the rotary gear 19 and the guiding member 20 are rotated clockwise or counter-clockwise, only one of the guide pins 15 and 16 comes into contact with the guiding member 20 or slides on the guiding member 20. Here, the upper guide pin 15 acts as what regulates the retraction of the plunger 9, whereas the lower guide pin 16 acts as what regulates the protrusion of the plunger 9. Accordingly, the load to be borne by one guide pin can be reduced to approximately one half of that of pins of conventional actuators, so that lifetimes of the individual guide pins 15 and 16 are at least two times as long as those of pins of the conventional actuators. Thus, the electric actuator of this embodiment is superior in durability to the conventional electric actuators.

Since the guide pins 15 and 16 are elliptically formed, they come into line-contact with the upper or lower surface of the guiding member 20. This line-contact smoothens the sliding motions of the guide pins 15 and 16 with respect to the guiding member 20. In addition, when the guide pins 15 and 16 come into contact with the first position regulating surface 23*a* or the second position regulating surface 23*b* of the guiding member 20, their contact surfaces 18*a* and 18*b* make facial contact (i.e., face to face contact) with the position regulating surface 23*a* or 23*b* to damp the impact upon the guide pins 15 and 16.

According to this first embodiment, the component for directly supporting the rotary gear 19 can be omitted. This simplifies the construction of the electric actuator 1.

In the case where the electric actuator 1 and the locking device 14 coupled together are to be assembled on the door, the assembling is generally accomplished such that the locking device 14 is in the unlock state whereas the plunger 9 is protruded outside the actuator 1. Suppose that an electric actuator is designed without any space S between the upper guide pin 15 and the guiding member 20. If, in this case, the plunger 9 is mounted below a predetermined position in the actuator due to an assembly error, this will cause the upper guide pin 15 to interfere with the upper end portion of the guiding member 20, blocking the rotations of the rotary gear 19 and the guiding member 20.

According to the first embodiment, however, the space S as shown in FIG. 3 inhibits the mutual interference between the upper guide pin 15 and the upper end portion of the guiding member 20, even if the plunger 9 is attached to a position slightly below the predetermined position. As a result, this design can reliably prevent the electric actuator 1 from becoming inoperative due to the assembly error.

In this first embodiment, the rotary gear 19 may be integrated with the guiding member 20 to form a single member. In order to reduce the weight of the electric actuator 1 in this embodiment, the casing 2, pinion 6, plunger 9, rotary gear 19 and guiding member 20 are made of resins. In contrast, they may be made of metals, if necessary. Moreover, the protrusion or intrusion of the plunger 9 may be adjusted by adjusting the lead angles of the guide surfaces 21*a* and 21*b* which are formed on the guiding member 20.

Second Embodiment

A second embodiment according to the present invention will be described with reference to FIGS. 11 to 18. The parts common to those of the foregoing first embodiment are designated at the identical reference numerals, and their detailed description will be omitted.

Figure 11:
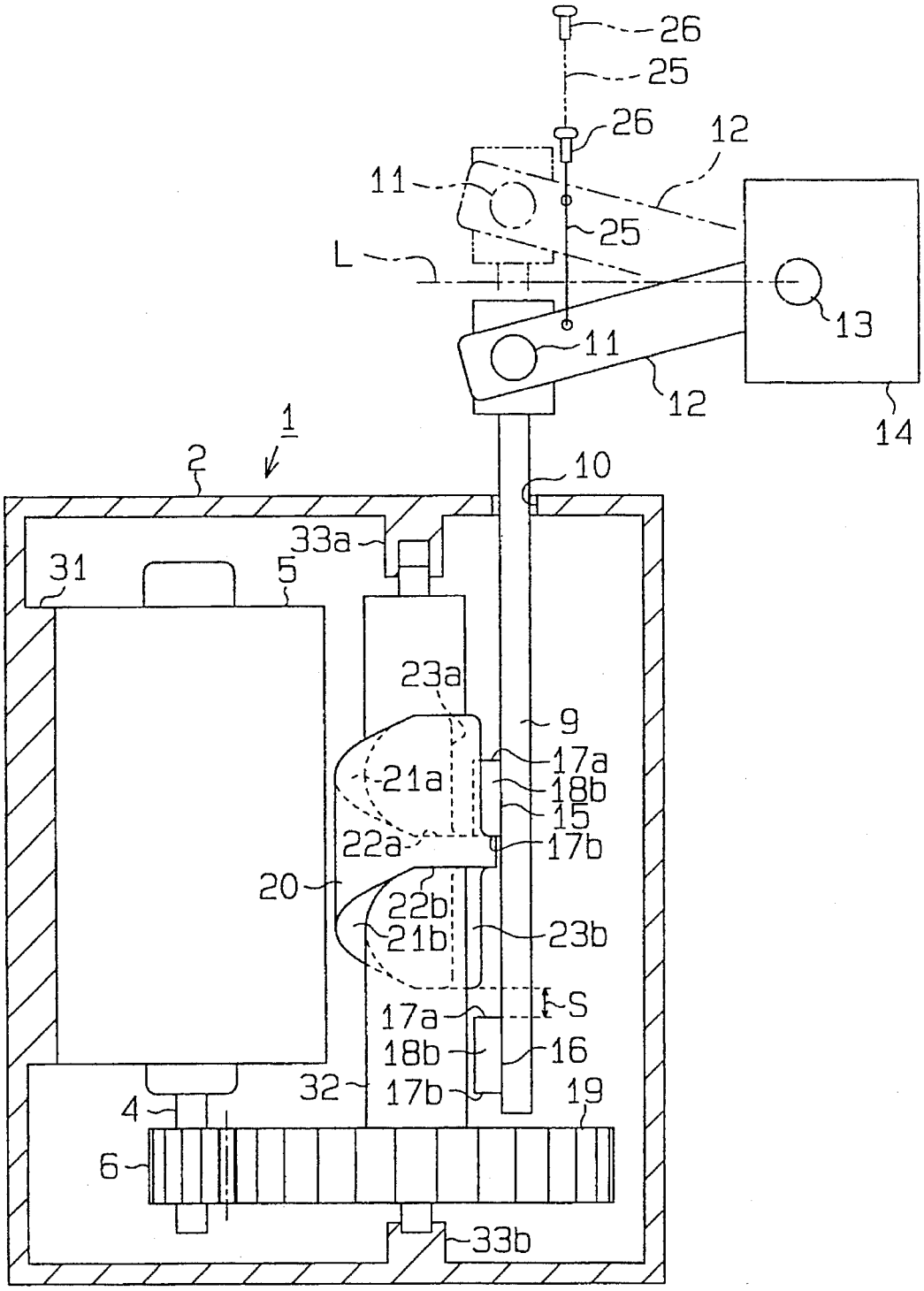

As shown in FIG. 11, a casing 2 is provided with a support 31 formed on its inner wall. A drive motor 5 is fixed on the support 31, and has its drive shaft 4 directed downward. A resinous pinion is fixed on the drive shaft 4. In the casing 2, a resinous rotary shaft 32 is rotatably supported by bearing portions 33*a* and 33*b* formed on the upper and lower portions of the casing 2. With the lower end of the rotary shaft 32, there is integrally formed the resinous rotary gear 19, which is engaged with the pinion 6.

A planar shaped plunger 9, made of a resin, is provided at the righthand side of the rotary shaft 32, and has a leading end protruding outside through the bore of the casing 2. The plunger 9 is coupled with the locking device 14 via the lever 12, like the foregoing first embodiment.

Figure 18:
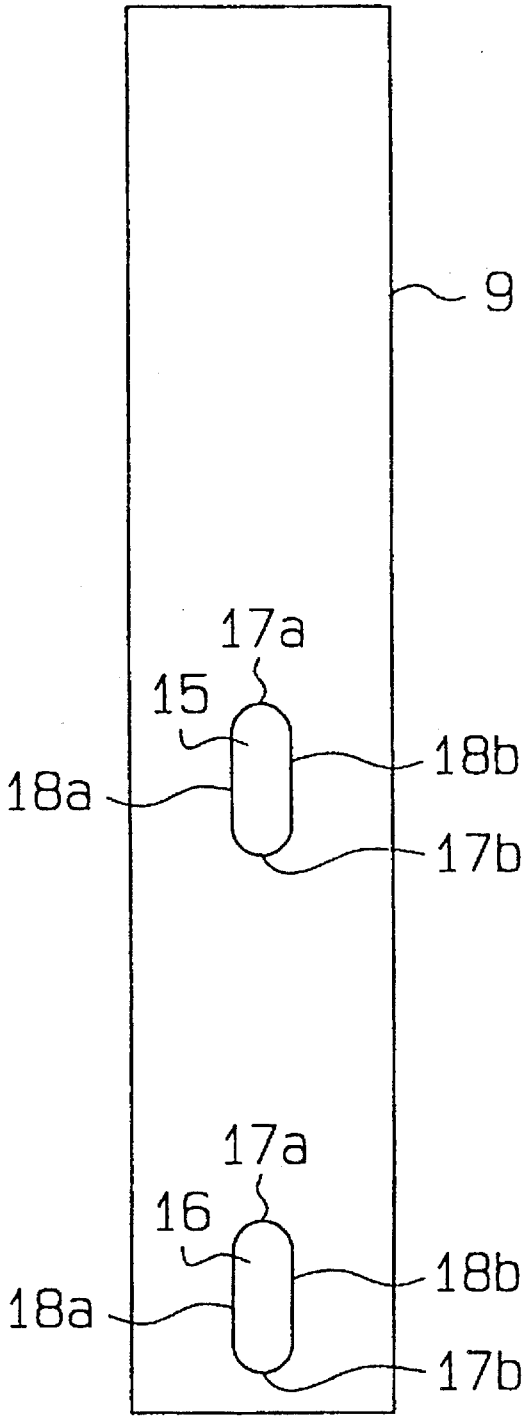

As shown in FIG. 18, the plunger 9 has a pair of guide pins 15 and 16 formed on its side to face the rotary shaft 32. These guide pins 15 and 16 are elliptically formed, and has arcuate contact-sliding portions 17*a* and 17*b* formed at their upper and lower portions and flat contact surfaces 18*a* and 18*b* formed at their right and lefthand sides.

The rotary shaft 32 has the guiding member 20 formed integrally therewith at its center. This guiding member 20 has a spiral first guide surface 21*a* formed on its upper surface and a spiral second guide surface 21*b* formed on its lower surface. The first guide surface 21*a* couples with a first flat surface 22*a* and a first position regulating surface 23*a*, and the second guide surface 21*b* couples with a first flat surface 22*b* and a second position regulating surface 23*b*.

When the contact-sliding portion 17*b* of the upper guide pin 15 comes into contact with the first flat surface 22*a* and when the contact surface 18*b* of the guide pin 15 comes into contact with the first position regulating surface 23*a*, the retraction of the plunger 9 into the casing 2 is regulated. At this time, the space S is formed between the contact-sliding portion 17*a* of the lower guide pin 16 and the upper end of the guiding member 20, and allows erection tolerance in assembling the actuator.

Figure 12:
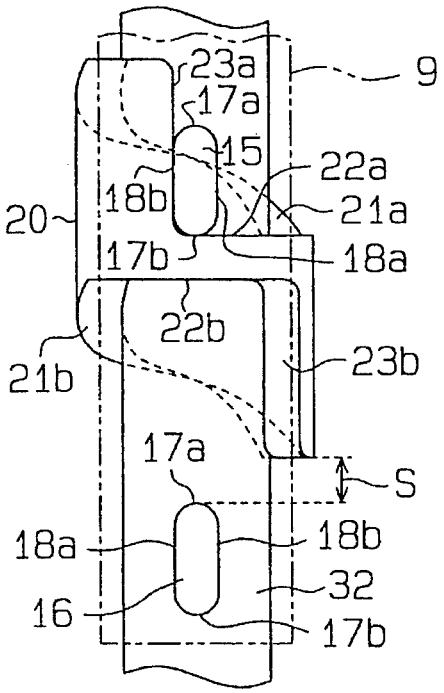

In the case where the contact surface 18*b* of the upper guide pin 15 is in contact with the first position regulating surface 23*a* and where the contact-sliding portion 17*b* of the guide pin 15 is in contact with the first flat surface 22*a*, as shown in FIGS. 11 and 12, the plunger 9 is retracted into the casing 2. At this time, the locking device 14 is in the lock state, in which the door 101 cannot be opened by the manipulation of the door handle.

Figure 13:
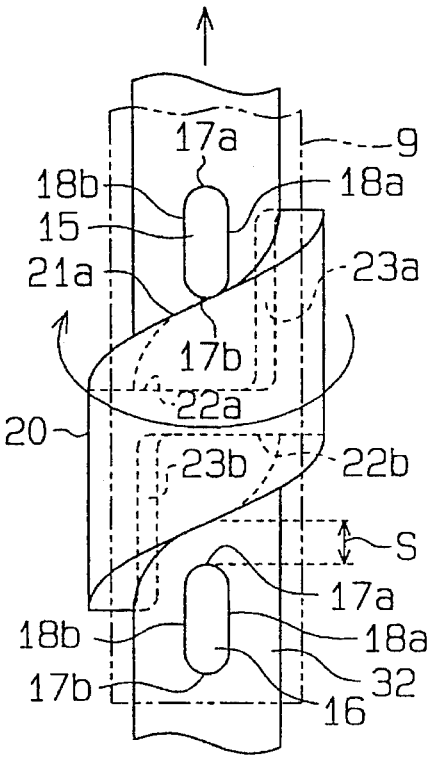

When the rotary gear 19, the rotary shaft 32 and the guiding member 20 are rotated clockwise by the drive of the motor 5, the contact-sliding portion 17*b* of the upper guide pin 15 slides via the flat surface 22*a* along the guide surface 21*a*, as shown in FIG. 13. As the guiding member 20 rotates, the plunger 9 protrudes out of the casing 2. As long as the lever 12 is not above the horizontal line L, the lower guide pin 16 does not come into contact with the guiding member 20 but is spaced from the member 20 while keeping the predetermined space S therebetween.

When the lever 12 is located above the horizontal line L, the plunger 9 is urged upward by the action of the spring (not shown) in the locking device 14. Then, the upper guide pin 15 is spaced from the guiding member 20 by the gap of the space S, but the lower guide pin 16 is in contact with the guiding member 20.

Figure 14:
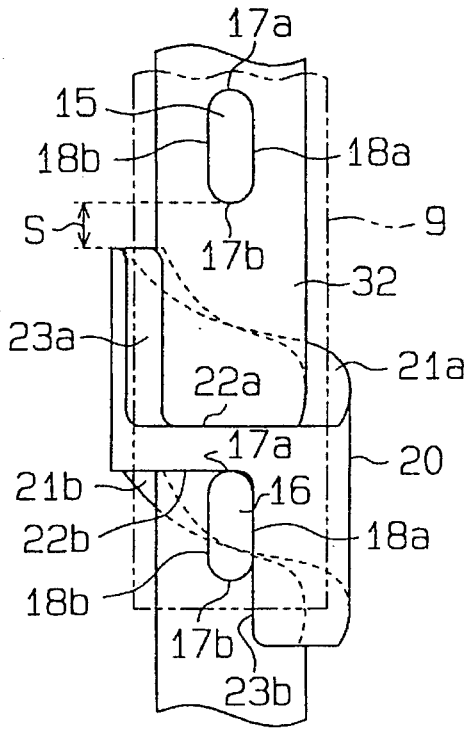

When the guiding member 20 is further rotated clockwise, the contact-sliding portion 17*a* of the lower guide pin 16 comes into contact with the flat surface 22*b*, as shown in FIG. 14, so that the contact surface 18*a* comes into contact with the second position regulating surface 23*b*. Then, not only the protrusion of the plunger 9 from the casing 2 but also the rotation of the rotary shaft 32 are regulated. Thus, the lever 12 is located at the uppermost position as indicated by the double-dotted lines in FIG. 11. Consequently, the locking device 14 comes into the unlock state, and the drive of the motor 5 is interrupted.

With the arrangement as shown in FIG. 14, when the rotary gear 19, the rotary shaft 32 and the guiding member 20 are rotated counter-clockwise, the contact-sliding portion 17*a* of the lower guide pin 16 slides through the flat surface 22*b* along the guide surface 21*b*. As the guiding member 20 rotates, the plunger 9 retracts into the casing 2. As long as the lever 12 does not go down over the horizontal line L, the upper guide pin 15 does not contact with the guiding member 20 but is spaced from the guiding member 20 while keeping the space S.

When the lever 12 is located below the horizontal line L, the plunger 9 is urged downward by the action of the spring in the locking device 14. Then, the lower guide pin 16 is spaced from the guiding member 20 by the space S, but the upper guide pin 15 comes into contact with the guiding member 20.

Thereafter, when the contact-sliding portion 17*b* of the upper guide pin 15 comes into contact with the flat surface 22*a* and when the contact surface 18*a* of the guide pin 15 comes into contact with the first position regulating surface 23*a*, as shown in FIGS. 11 and 12, not only the retraction of the plunger 9 into the casing 2 but also the rotation of the rotary shaft 32 is regulated. Thus, the lever 12 is brought to the position as indicated by the solid lines, to bring the locking device 14 into the lock position. At this time, the drive of the motor 5 is interrupted.

The operations of the electric actuator 1 according to the second embodiment will be described below. With the arrangement as shown in FIGS. 11 and 12, the contact surface 18*b* of the upper guide pin 15 is in contact with the first position regulating surface 23*a*, and the contact-sliding portion 17*b* is in contact with the flat surface 22*a*. In this case, the intrusion of the plunger 9 into the casing 2 is inhibited to hold the locking device 14 in the lock state. When the rotary gear 19, the rotary shaft 32 and the guiding member 20 are rotated clockwise by the drive of the motor 5, the contact-sliding portion 17*b* of the upper guide pin 15 slides through the flat surface 22*a* along the guide surface 21*a*. As the guiding member 20 rotates, the plunger 9 protrudes out of the casing 2. So long as the lever 12 does not go up over the horizontal line L, the lower guide pin 16 is kept away contact with the guiding member 20 while being held at the space S.

When the lever 12 is located above the horizontal line L, the plunger 9 is urged upward by the action of the spring in the locking device 14. Then, the upper guide pin 15 is spaced from the guiding member 20 by the space S, but the lower guide pin 16 comes into contact with the lower end of the guiding member 20.

When the guiding member 20 is further rotated clockwise, the contact-sliding portion 17*a* of the lower guide pin 16 comes into contact with the flat surface 22*b*, as shown in FIG. 14, so that the contact surface 18*a* comes into contact with the second position regulating surface 23*b*. Then, not only the protrusion of the plunger 9 from the casing 2 but also the rotation of the rotary shaft 32 is regulated to bring the lever 12 to the position as indicated by the double-dotted lines in FIG. 11. At this time, the locking device 14 comes into the unlock state, and the drive of the motor 5 is interrupted.

Figure 15:
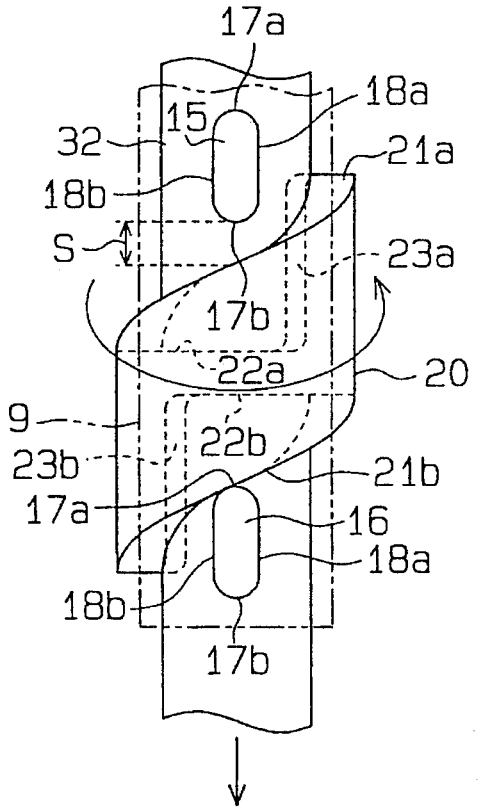
Figure 16:
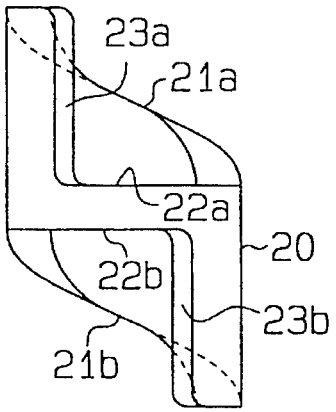
Figure 17:
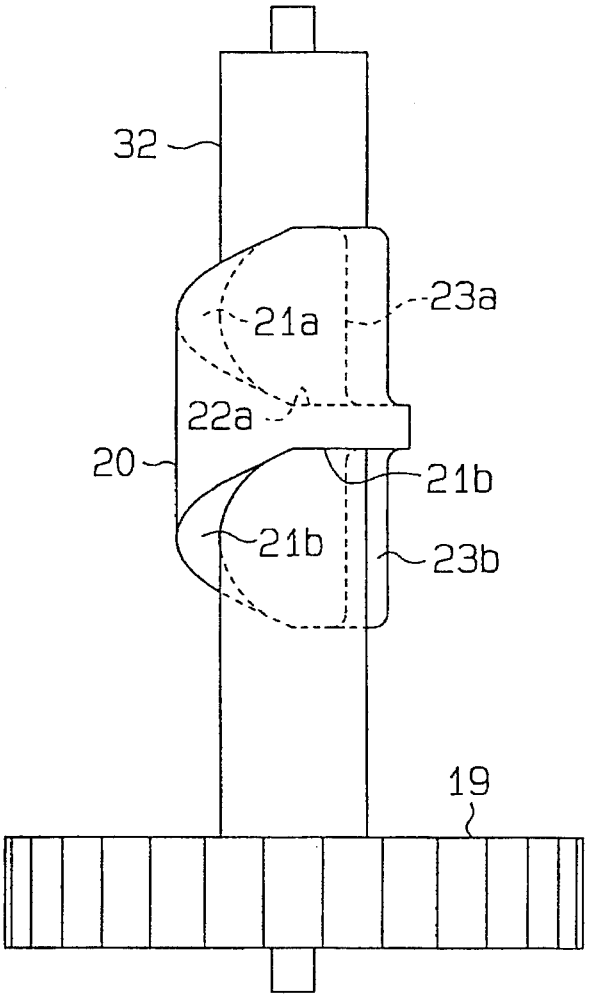

With the arrangement as shown in FIG. 14, when the rotary gear 19, the rotary shaft 32 and the guiding member 20 are rotated counter-clockwise, the contact-sliding portion 17*a* of the lower guide pin 16 slides through the flat surface 22*b* along the guide surface 21*b*, as shown in FIG. 15. As the guiding member 20 rotates, the plunger 9 is retracted into the casing 2. So long as the lever 12 does not go down over the horizontal line L, the upper guide pin 15 does not contact with the guiding member 20, but is spaced from the member 20 by the space S. When the lever 12 is located below the horizontal line L, the plunger 9 is urged downward by the action of the spring in the locking device 14. Then, the lower guide pin 16 is spaced by the space S from the guiding member 20, but the upper guide pin 15 comes into contact with the guiding member 20.

Thereafter, when the contact-sliding portion 17*b* of the upper guide pin 15 comes into contact with the flat surface 22*a* and when its contact surface 18*b* comes into contact with the first position regulating surface 23*a*, as shown in FIGS. 11 and 12, not only the intrusion of the plunger 9 but also the rotation of the rotary shaft 32 is regulated. Thus, the lever 12 is moved to the position as indicated by the solid lines, so that the locking device 14 comes into the lock state. At this time, the drive of the motor 5 is interrupted.

According to this embodiment, either of the upper and lower guide pins 15 and 16 comes into contact with the guiding member 20 even when the rotary gear 19 and the guiding member 20 rotate. As a result, the loads to be borne by the individual guide pins 15 and 16 are reduced to approximately one half of that of pins of conventional actuators, like the first embodiment. This drastically elongates the lifetimes of the guide pins 15 and 16, in contrast with conventional actuators.

In this second embodiment, since the guide pins 15 and 16 are formed integrally with the plunger 9, they can sufficiently endure the impact which is established when they collide against the first and second position regulating surfaces 23*a* and 23*b*, respectively.

Since the individual guide pins 15 and 16 are elliptically formed, like the first embodiment, the pins 15 and 16 come into line-contact with the upper and lower surfaces of the guiding member 20, respectively. This smoothens the sliding motions of the pins 15 and 16 with respect to the guiding member 20. Moreover, since the collisions of the guide pins 15 and 16 against the position regulating surface 23*a* or 23*b* are in facial contact, the impacts to be received by the guide pins 15 and 16 can be damped to some extent.

The role of the space S in this second embodiment is substantially similar to that of the first embodiment. Accordingly, the actuator of this second embodiment can also be kept away from the inoperative state which might otherwise be caused by the assembly error.

Although the casing 2, pinion 6, plunger 9, guide pins 15 and 16, rotary gear 19 and guiding member 20 are made of resins in order to reduce the weight of the actuator 1 in this embodiment, their components may be made of metals, if necessary. Moreover, the protrusion or intrusion of the plunger 9 may be adjusted by adjusting the lead angles of the guide surfaces 21*a* and 21*b* formed on the guiding member 20.

Third Embodiment

A third embodiment of the present invention will be described with reference to FIGS. 19 to 25. The parts common to those of the foregoing first embodiment are designated at the identical reference numerals, and their detailed description will be omitted.

Figure 19:
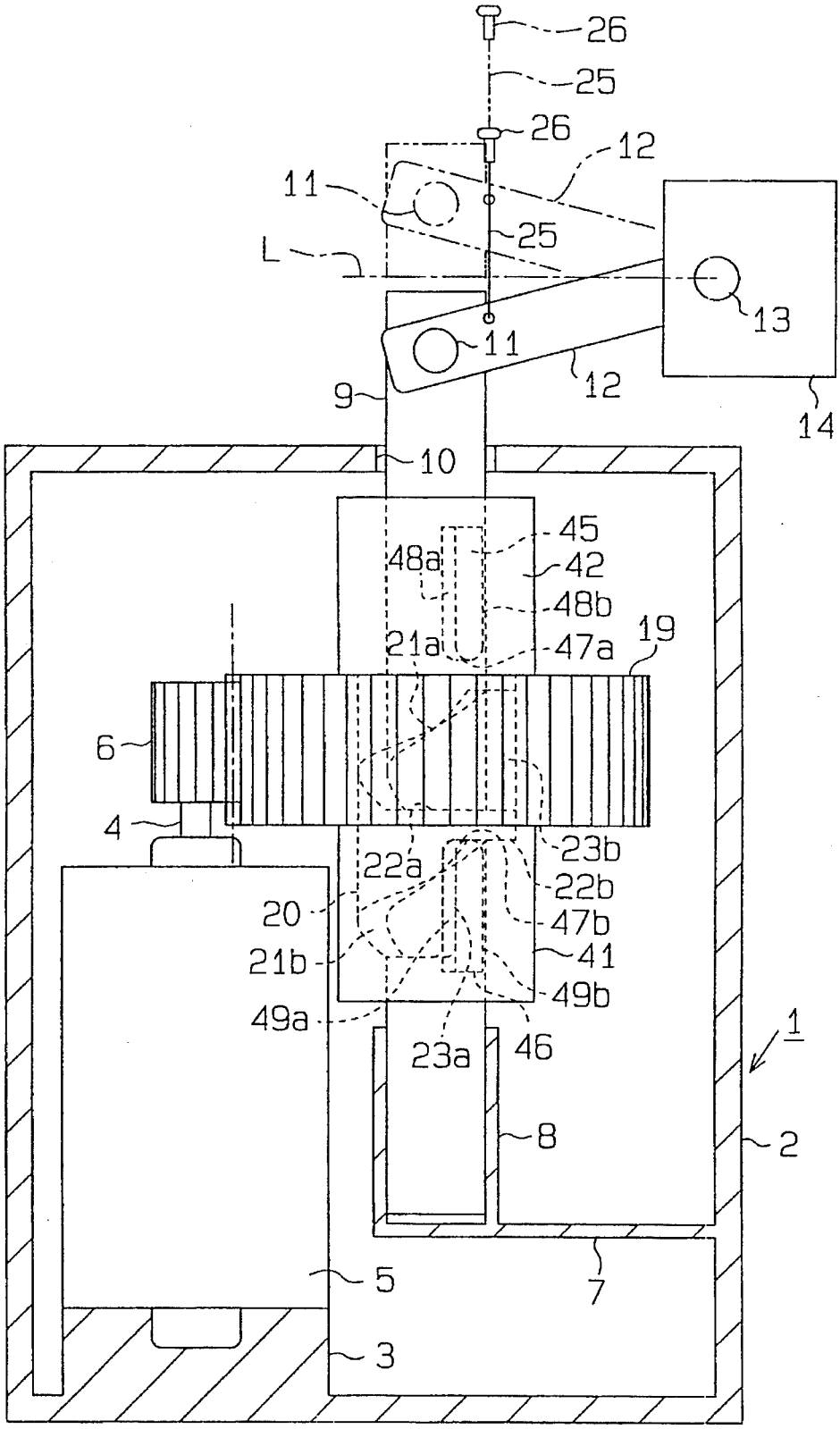
Figure 25:
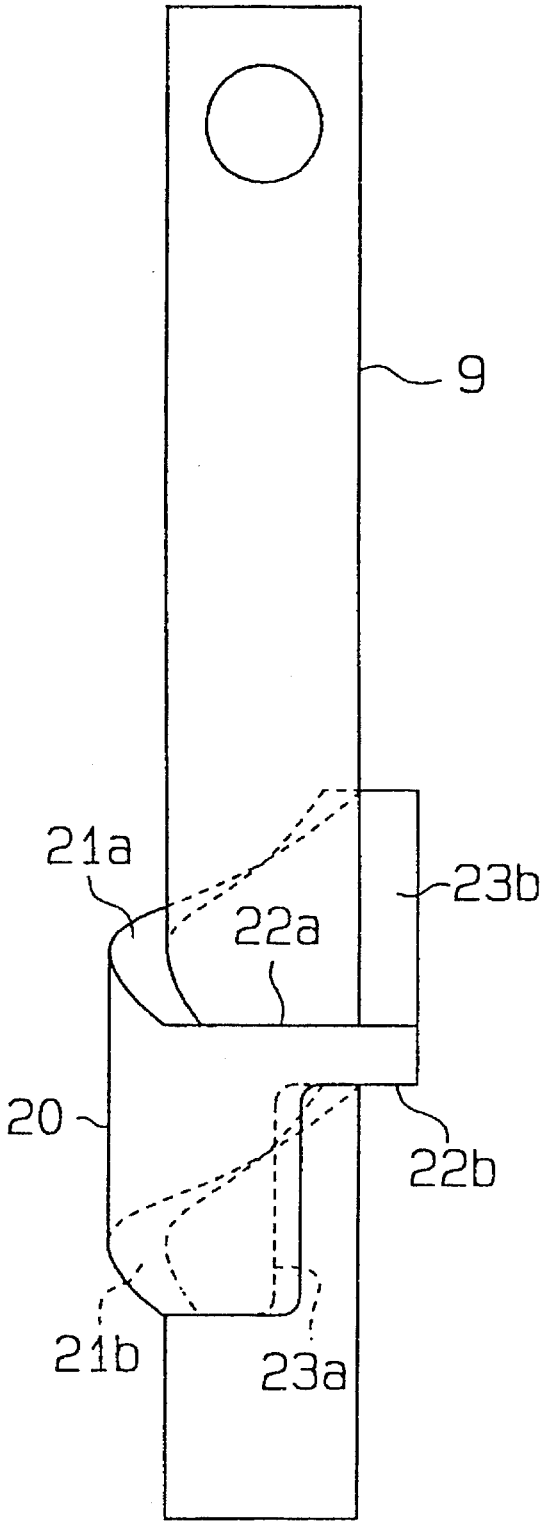

As shown in FIGS. 19 and 25, a resinous plunger 9 is formed integrally with a resinous guiding member 20 as a leading member. This guiding member 20 has guide surfaces 21*a* and 21*b*, flat surfaces 22*a* and 22*b*, and the first and second position regulating surfaces 23*a* and 23*b*. The top end of the plunger 9 is connected to the locking device 14 via the lever 12, like the first embodiment.

The resinous rotary gear 19 has a lower resinous support pipe 41 formed integrally with the lower end of the gear 19. An upper resinous support pipe 42 is fitted onto the upper end of the rotary gear 19. Moreover, these lower and upper support pipes 41 and 42 form a supporting member 43. The guiding member 20 of the plunger 9 is inserted into the supporting member 43.

Figure 20:
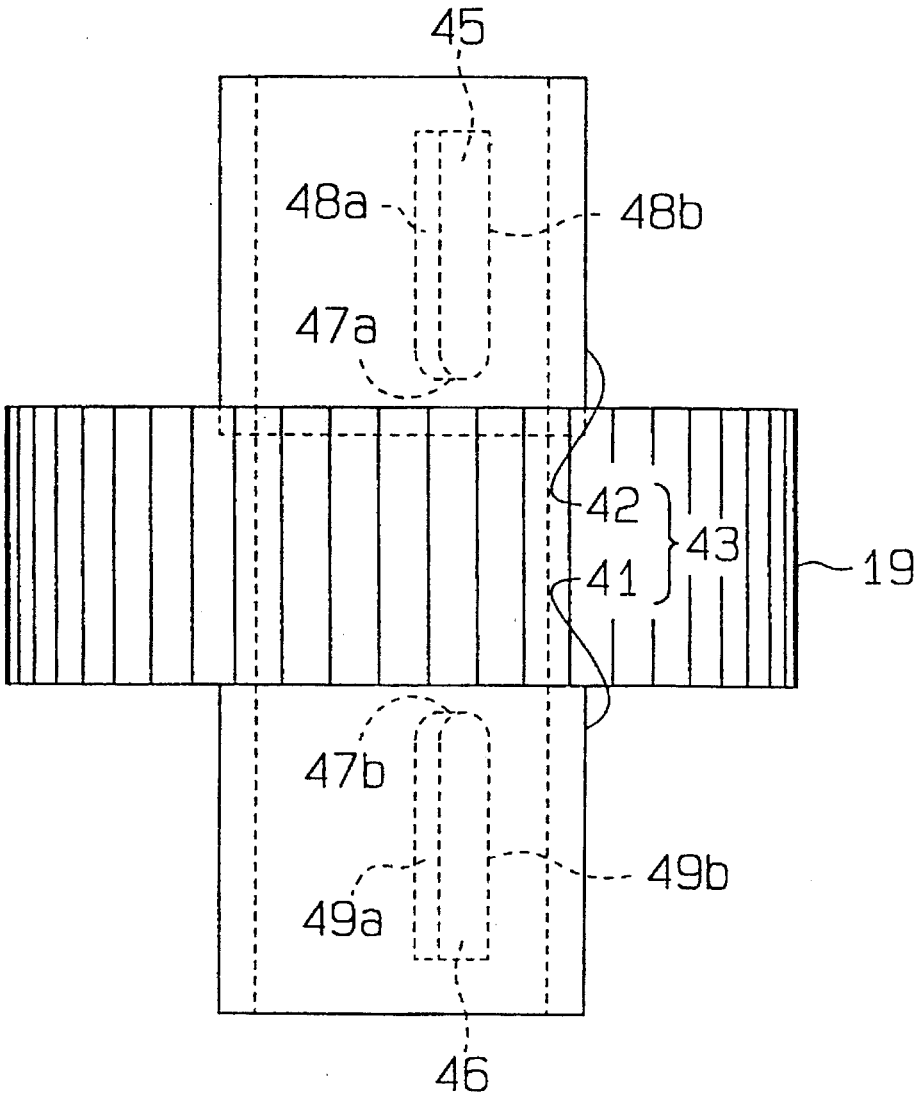

As shown in FIG. 20, the lower and upper support pipes 41 and 42 are integrally formed on their inner circumferences with upper and lower guide pins 45 and 46 as a first and second movement guiding members. The upper guide pin 45 has an arcuate contact-sliding portion 47*a* formed at its lower portion, and straight contact surfaces 48*a* and 48*b* formed on the right and left sides of the pin 45. Likewise, the lower guide pin 46 has an arcuate contact-sliding portion 47*b* formed at its upper portion, and straight contact surfaces 49*a* and 49*b* formed on the right and left sides of the pin 46.

Figure 21:
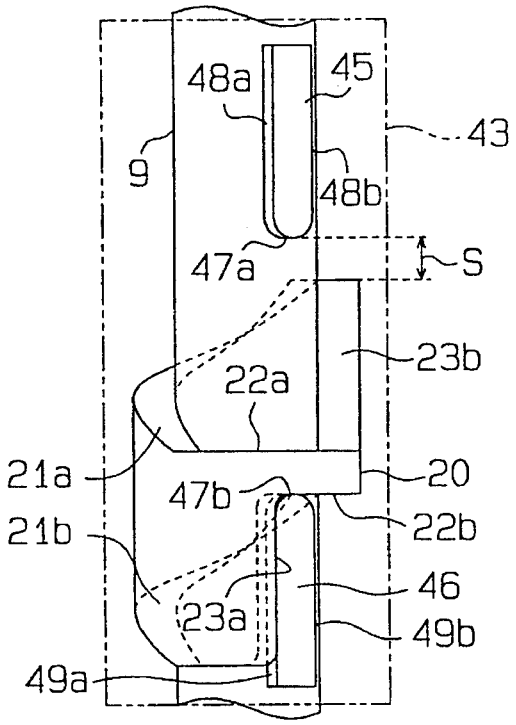

When the contact-sliding portion 47*b* of the lower guide pin 46 of the supporting member 43 comes into contact with the flat surface 22*b* of the guiding member 20 and when the contact surface 49*a* of the guide pin 46 comes into contact with the first position regulating surface 23*a*, as shown in FIG. 21, the protrusion of the plunger 9 is regulated. At this time, the space S is formed between the contact-sliding portion 47*a* of the upper guide pin 45 and the upper end of the guiding member 20, and allows erection tolerance in assembling the actuator.

When the contact surface 49*a* of the guide pin 46 is in contact with the first position regulating surface 23*a* and when the contact-sliding portion 47*b* of the guide pin 46 is in contact with the flat surface 22*b*, as shown in FIGS. 19 and 21, the plunger 9 is retracted into the casing 2. At this time, the lever 12 is located at the position as indicated by the solid lines. The locking device 14 is in the lock state, in which the door 101 cannot be opened by the manipulation of the door handle 103.

Figure 22:
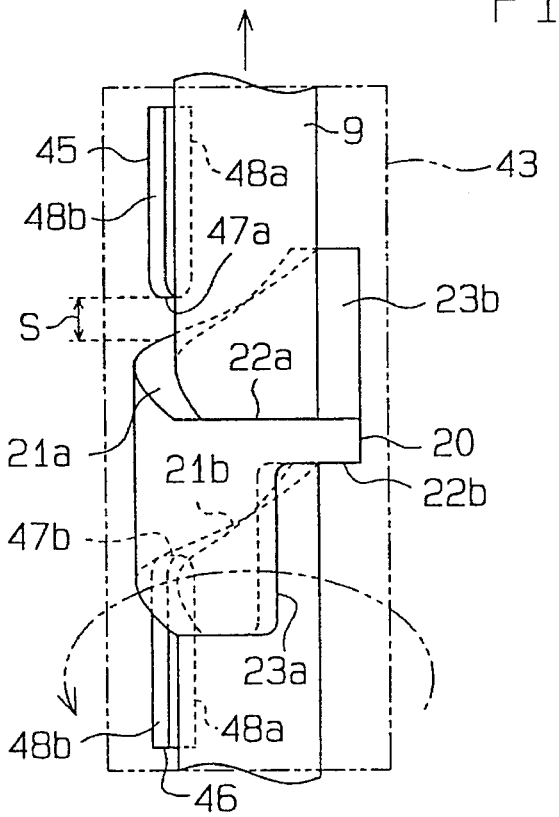

When the rotary gear 19, the supporting member 43 and the guide pins 45 and 46 are rotated counter-clockwise by the drive motor 5, the contact-sliding portion 47*b* of the guide pin 46 slides via the flat surface 22*b* along the guide surface 21*b*, as shown in FIG. 22. In accordance with these rotations, the plunger 9 is protruded from the casing 2. So long as the lever 12 does not go up over the horizontal line L, the upper guide pin 45 does not contact with the guiding member 20 but is spaced from the member 20 by the space S. When the lever 12 is located above the horizontal line L, the plunger 9 is urged upward by the action of the spring (not shown) in the locking device 14. Then, the lower guide pin 46 is spaced by the space S from the guiding member 20, whereas the upper guide pin 45 comes into contact with the guiding member 20.

Figure 23:
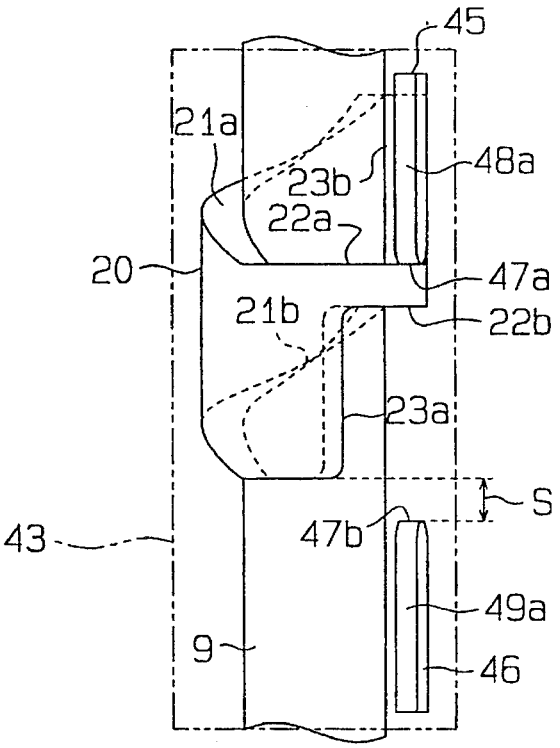

When the guiding member 20 is further rotated counter-clockwise, the contact-sliding portion 47*a* of the upper guide pin 45 comes into contact with the flat surface 22*a*, and the contact surface 48*a* comes into contact with the second position regulating surface 23*b*, as shown in FIG. 23. Then, not only the protrusion of the plunger 9 but also the rotation of the rotary gear 19 is regulated. At this time, the lever 12 is located at the position as indicated by the double-dotted lines, so that the locking device 14 comes into the unlock state, in which the door 101 can be opened by the manipulation of the door handle 103. Incidentally, the drive of the motor 5 is then interrupted.

Figure 24:
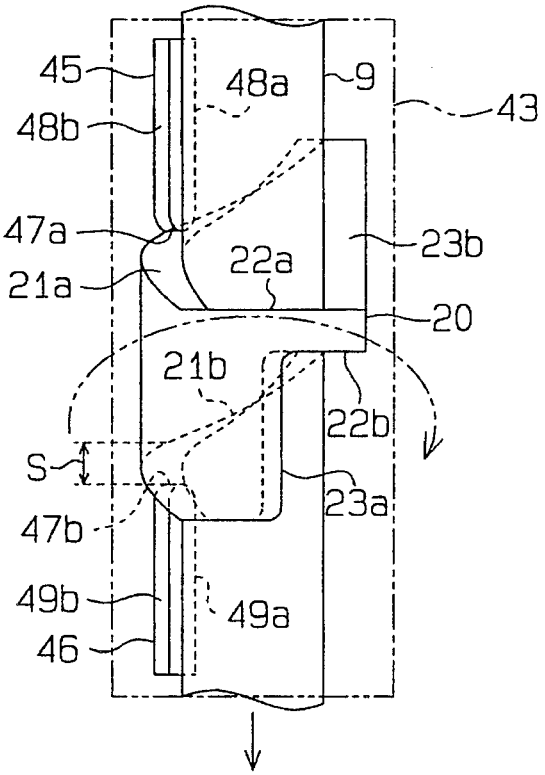

With the arrangement as shown in FIG. 23, when the rotary gear 19, the supporting member 43 and the guide pins 45 and 46 are rotated clockwise, the contact-sliding portion 47*a* of the upper guide pin 45 slides via the flat surface 22*a* along the guide surface 21*a*, as shown in FIG. 24. In accordance with these rotations, the plunger 9 is retracted into the casing 2. So long as the lever 12 does not go down over the horizontal line L, the lower guide pin 46 does not come into contact with the guiding member 20 but is spaced therefrom by the space S. When the lever 12 is located below the horizontal line L, the plunger 9 is urged downward by the action of the spring in the locking device 14. Then, the upper guide pin 45 is spaced from the guiding member 20 by the space S, whereas the lower guide pin 46 comes into contact with the guiding member 20.

Thereafter, when the contact-sliding portion 47*b* of the lower guide pin 46 comes into contact with the flat surface 22*b*, and when the contact surface 49*a* of the guide pin 46 comes into contact with the first position regulating surface 23*a*, as shown in FIGS. 19 and 21, not only the retraction of the plunger 9 but also the rotation of the rotary gear 19 is regulated. Thus, the lever 12 moves to the position as indicated by the double-dotted lines, so that the locking device 14 comes into the unlock state. Moreover, the drive of the motor 5 is interrupted.

The operations of the electric actuator 1 according to this embodiment will be described below. With the arrangement as shown in FIGS. 19 and 21, the contact surface 49*a* of the lower guide pin 46 is in contact with the first position regulating surface 23*a*, and the contact-sliding portion 47*b* of the guide pin 46 is in contact with the flat surface 22*b*. In this case, the plunger 9 is retracted into the casing 2 so that the locking device 14 takes the lock state.

When the rotary gear 19, the supporting member 43 and the guide pins 45 and 46 are rotated counter-clockwise by the drive of the motor 5, the contact-sliding portion 47*b* of the lower guide pin 46 slides along the guide surface 21*b*, as shown in FIG. 22. Then, the plunger 9 protrudes upward. So long as the lever 12 does not go up over the horizontal line L, the upper guide pin 45 does not come into contact with the guiding member 20 but is spaced therefrom by the space S. When the lever 12 is located above the horizontal line L, the plunger 9 is urged upward by the action of the spring in the locking device 14. Then, the lower guide pin 46 is spaced from the guiding member 20 by the space S whereas the upper guide pin 45 comes into contact with the guiding member 20.

When the guiding member 20 is further rotated counter-clockwise, the contact-sliding portion 47*a* of the upper guide pin 45 comes into contact with the flat surface 22*a*, and the contact surface 48*b* comes into contact with the second position regulating surface 23*b*. Then, not only the protrusion of the plunger 9 but also the rotation of the rotary gear 19 is regulated. Thus, the lever 12 is moved to the position as indicated by the double-dotted lines, so that the locking device 14 comes into the unlock state. At this time, the drive of the motor 5 is interrupted.

With the arrangement as shown in FIG. 23, when the rotary gear 19, the supporting member 43 and the guide pins 45 and 46 are rotated clockwise by the drive of the motor 5, the contact-sliding portion 47*a* of the upper guide pin 45 slides through the flat surface 22*a* along the guide surface 21*a*, as shown in FIG. 24. In accordance with these rotations, the plunger 9 is retracted into the casing 2. So long as the lever 12 does not go down over the horizontal line L, the lower guide pin 46 does not come into contact with the guiding member 20 but is spaced therefrom by the space S. When the lever 12 is located below the horizontal line L, the plunger 9 is urged downward by the action of the spring in the locking device 14. Then, the upper guide pin 45 is spaced from the guide member 20 by the space S whereas the lower guide pin 46 comes into contact with the guiding member 20.

Thereafter, the contact-sliding portion 47*b* of the lower guide pin 46 comes into contact with the flat surface 22*b* whereas the contact surface 49*a* of the guide pin 46 comes into contact with the first position regulating surface 23*a*, as shown in FIGS. 19 and 21. Then, not only the retraction of the plunger 9 but also the rotation of the rotary gear 19 is regulated. Thus, the lever 12 is moved to the position as indicated by the solid lines, so that the locking device 14 takes the lock state. At this time, the drive of the motor 5 is interrupted.

According to this third embodiment, only one of the guide pins 45 and 46 contacts or slides with respect to the guiding member 20. As in the first and second embodiments, therefore, the loads to be borne by the individual guide pins 45 and 46 are approximately one half as large as that of the pins of conventional actuators. This improves the lifetimes of the guide pins 45 and 46 in contrast with those of the conventional actuators.

Since the guide pins 45 and 46 are formed integrally with the lower and upper support pipes 41 and 42, the shock resistances of the guide pins 45 and 46 can be improved in the case where the pins 45 and 46 collide with the first and second position regulating surfaces 23*a* and 23*b*.

Since the guide pins 45 and 46 are elliptically formed, like the first and second embodiments, they come into line-contact with the upper or lower surface of the guiding member 20. This smoothens the sliding motions of the pins 45 and 46 with respect to the guiding member 20. Moreover, the facial contacts of the guide pins 45 and 46 with the first and second position regulating surfaces 23*a* and 23*b* can damp the impacts to be received by the pins 45 and 46.

The role of the space S in this third embodiment is substantially identical to that of the first embodiment. Accordingly, the actuator of this third embodiment can also be kept away from the inoperative state which might otherwise be caused by the assembly error.

Although the casing 2, the pinion 6, the plunger 9, the rotary gear 19, the supporting member 43, and the guide pins 45 and 46 are made of resins in order to reduce the weight of the actuator 1, they may be made of metals, if necessary. Moreover, the protrusion and retraction of the plunger 9 may be adjusted by adjusting the lead angles of the guide surfaces 21*a* and 21*b* which are formed on the guiding member 20.

Fourth Embodiment

A fourth embodiment of the present invention will be described with reference to FIGS. 26 to 35. The parts common to those of the foregoing first to third embodiments are designated at the identical reference numerals, and their detailed description will be omitted.

Figure 26:
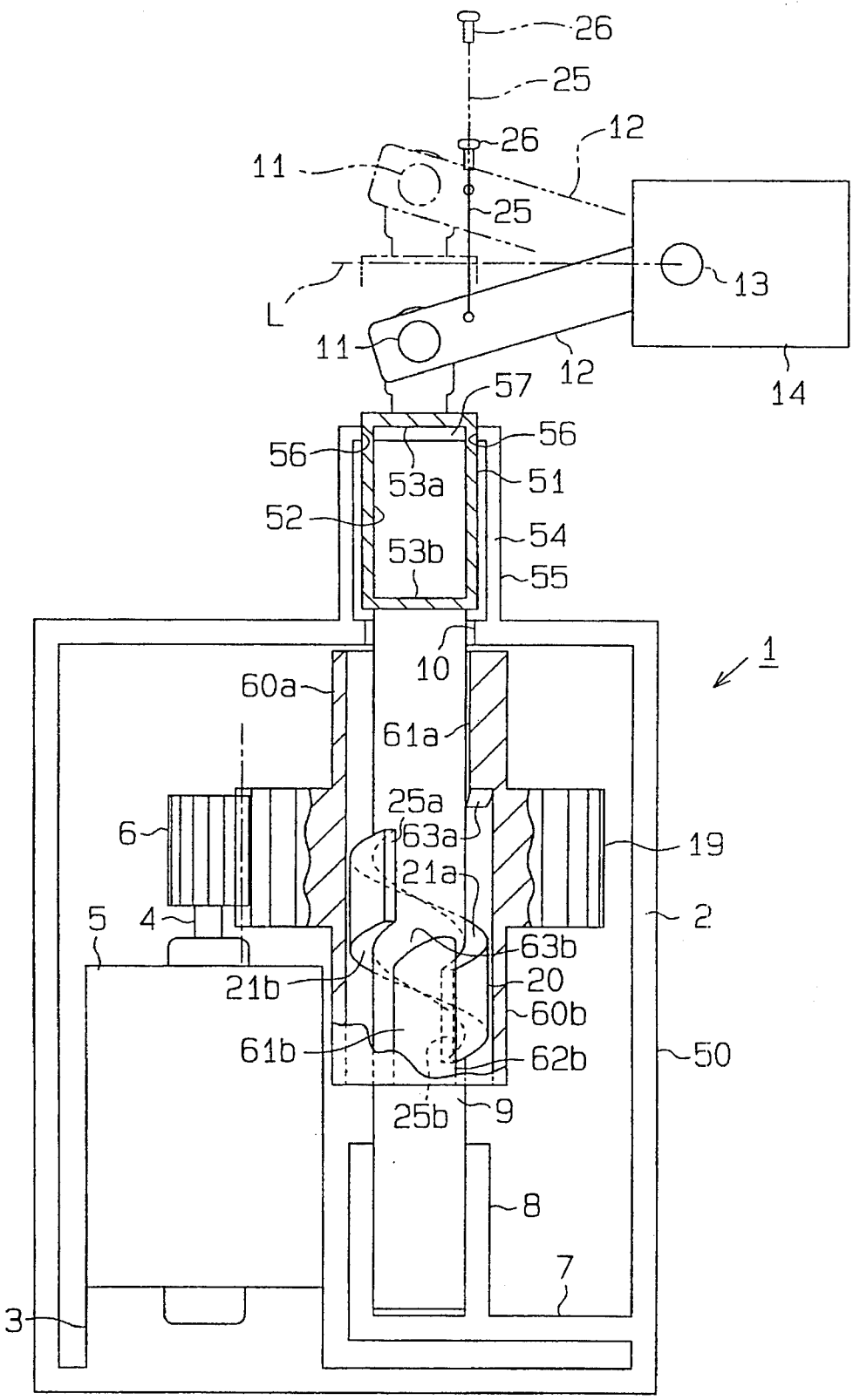

A boxy casing 2, as shown in FIG. 26, is constructed by combining two resinous separate casing parts 50 (only one of them is shown in FIG. 26). A bed 3, support wall 7, sleeve portion 8 and bore 10 are formed in the casing 2 by combining the two casing parts 50.

Figure 27:
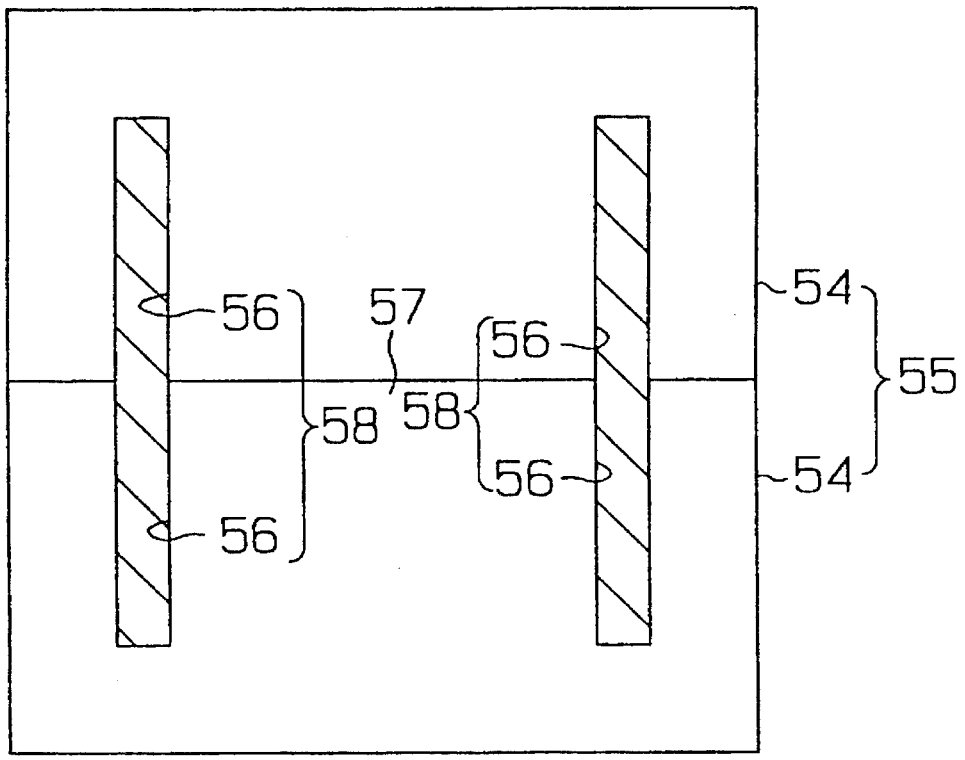

As shown in FIGS. 26 and 27, a resinous plunger 9 has its upper portion protruding upward from the upper surface of the casing 2 through the bore 10. A box-shaped stroke adjusting part 51 is provided at its upper portion of the plunger 9, and has a rectangular through hole 52 penetrating the adjusting part 51. An inner top surface of the through hole 52 serves as a first position regulating surface 53*a* and an inner bottom surface of the through hole 52 serves as a second position regulating surface 53*b*.

Each of the separate casing parts 50 has a regulating portion 54 formed thereon integrally with the part 50 to enclose the through hole 10. These two regulating portions 54 are combined to form a regulating body 55 having a square top plan shape. Each regulating portion 54 has two slits 56 formed therein. A stroke regulating piece 57 is provided between the two slits 56. When the two opposed regulating portions 54 are combined, as shown in FIG. 27, the paired slits 56 form two enlarged slits 58, into which the stroke adjusting part 51 should be inserted.

When the plunger 9 is moved up to bring the second position regulating surface 53*b* of the stroke adjusting part 51 into contact with the stroke regulating piece 57, its upward movement of the plunger 9 is regulated. On the other hand, when the plunger 9 is moved down to bring the first position regulating face 53*a* of the stroke adjusting part 51 into contact with the stroke regulating piece 57, its downward movement of the plunger 9 is regulated.

The plunger 9 is connected, via the connecting pin 11, to the lever 12 of the locking device 14. When the upward movement of the plunger 9 causes the connecting pin 11 to go up over the horizontal line L, the plunger 9 is urged upward by the action of the spring (not shown) provided in the locking device 14. When the second position regulating surface 53*b* of the stroke adjusting part 51 comes into contact with the stroke regulating piece 57, the upward protrusion of the plunger 9 is inhibited. When the downward movement of the plunger 9 causes the connecting pin 11 to go down below the horizontal line L, the plunger 9 is urged downward by the action of the spring in the locking device 14. When the first position regulating surface 53*a* of the stroke adjusting part 51 comes into contact with the stroke regulating piece 57, the retraction of the plunger 9 is inhibited.

The plunger 9 has a guiding member 20 formed thereon integrally with the plunger 9. The guiding member 20 is disposed within the casing 2, and serves as a leading member. This guiding member 20 is spirally formed, and has a first and second guide surfaces 21*a* and 21*b* at its respective upper and lower sides. The first guide surface 21*a* is so designed that it is moved up as the plunger 9 is rotated clockwise. The second guide surface 21*b* is so designed that it is moved down as the plunger 9 is rotated clockwise. The guiding member 20 further has a first and second regulation surfaces 25*a* and 25*b* formed at its respective tip ends. These two regulation surfaces 25*a* and 25*b* are so arranged that they do not overlap each other in the axial direction of the plunger 9. The guiding member 20 has its circumferential length designed not to make a round around the outer circumference of the plunger 9.

In the casing 2, the plunger 9 is inserted into a resinous rotary gear 19. The rotary gear 19 is equipped at its central portion with support sleeves 60*a* and 60*b* which are formed integrally with the upper and lower surfaces of the gear 19. These support sleeves 60*a* and 60*b* have a first and second guide pins 61*a* and 61*b* as movement guiding portions, which are integrally formed on their respective inner circumferential surfaces.

Figure 34:
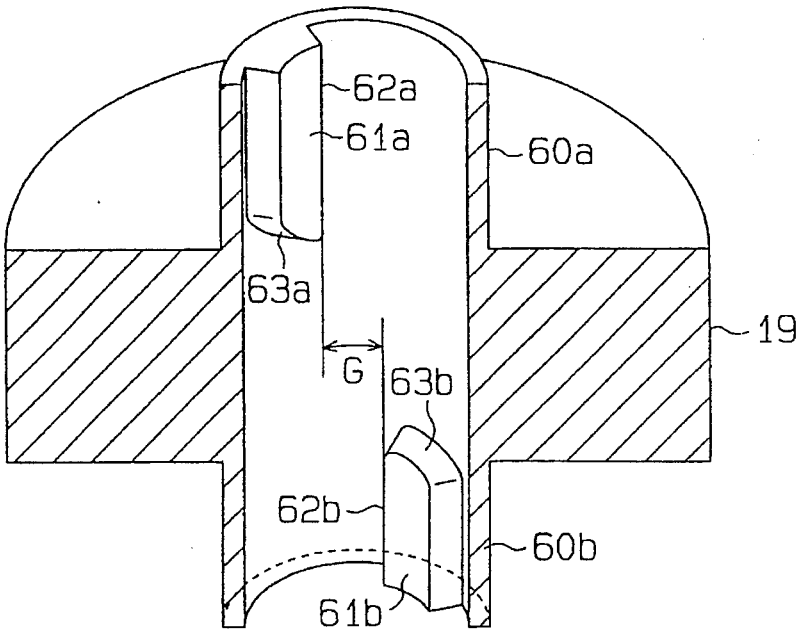

As shown in FIG. 34, the first guide pin 61*a* of the upper support sleeve 60*a* has a contact surface 62*a* formed on its one side portion for facial contact with the first regulation surface 25*a* of the guiding member 20, and a curved contact-sliding portion 63*a* formed on its lower end portion for contact with the first guide surface 21*a*. The second guide pin 61*b* of the lower support sleeve 60*b* has a contact surface 62*b* formed on its one side portion for facial contact with the second regulation surface 25*b* of the guiding member 20, and a curved contact-sliding portion 63*b* formed on its upper end portion for contact with the second guide surface 21*b*.

As shown in FIG. 34, the first and second guide pins 61*a* and 61*b* are spaced from each other by a predetermined gap G along the circumferences of the support sleeves 60*a* and 60*b*. In this embodiment, the predetermined gap G is so set that the contact surface 62*a* of the first guide pin 61*a* is circumferentially spaced from the first regulation surface 25*a* of the guiding member 20 when the contact surface 62*b* of the second guide pin 61*b* comes into contact with the second regulation surface 25*b* of the guiding member 20. Accordingly, the first and second guide pins 61*a* and 61*b* are so arranged that they do not face to each other along a common axis of the plunger 9.

Figure 28:
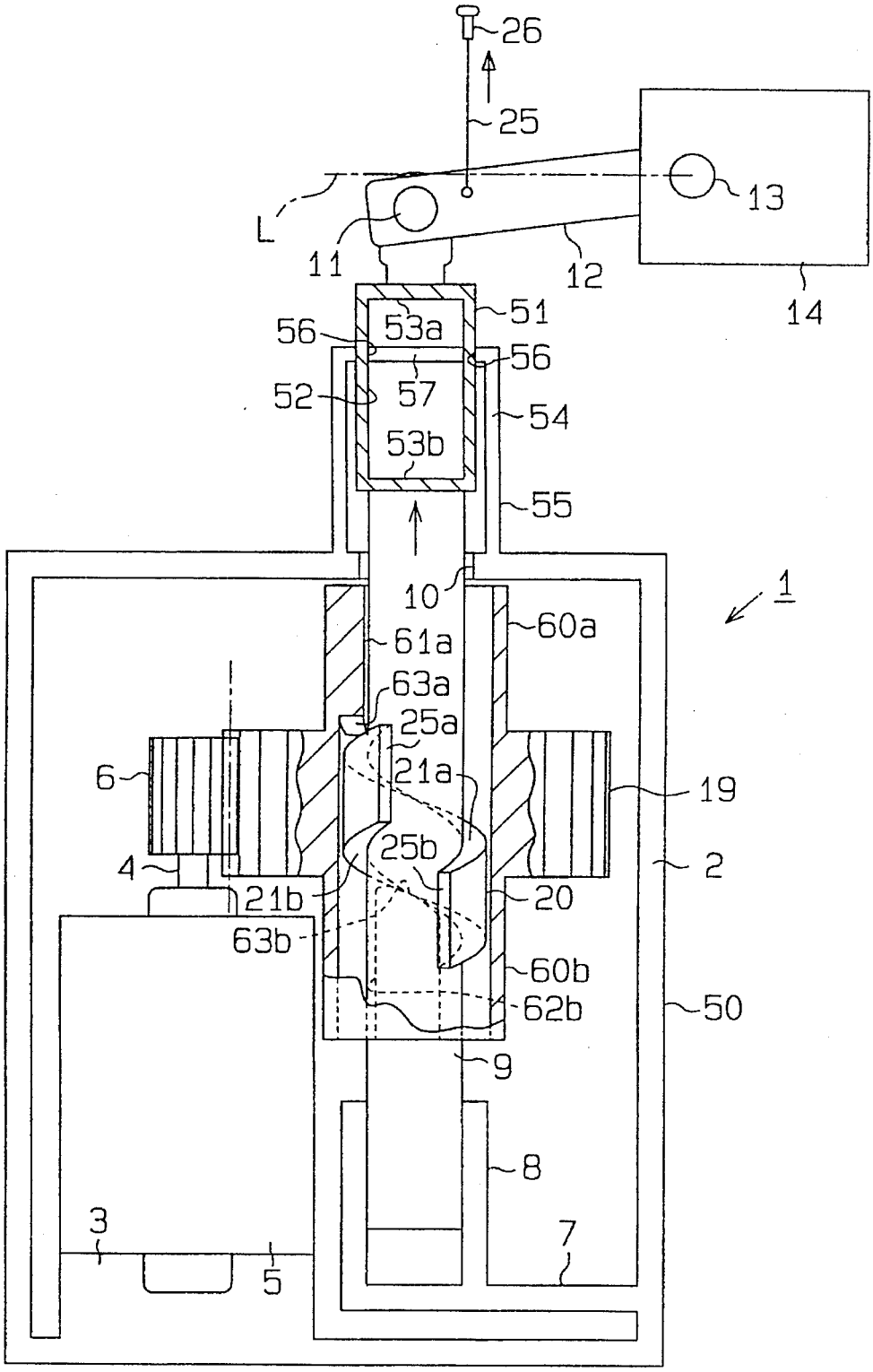
Figure 29:
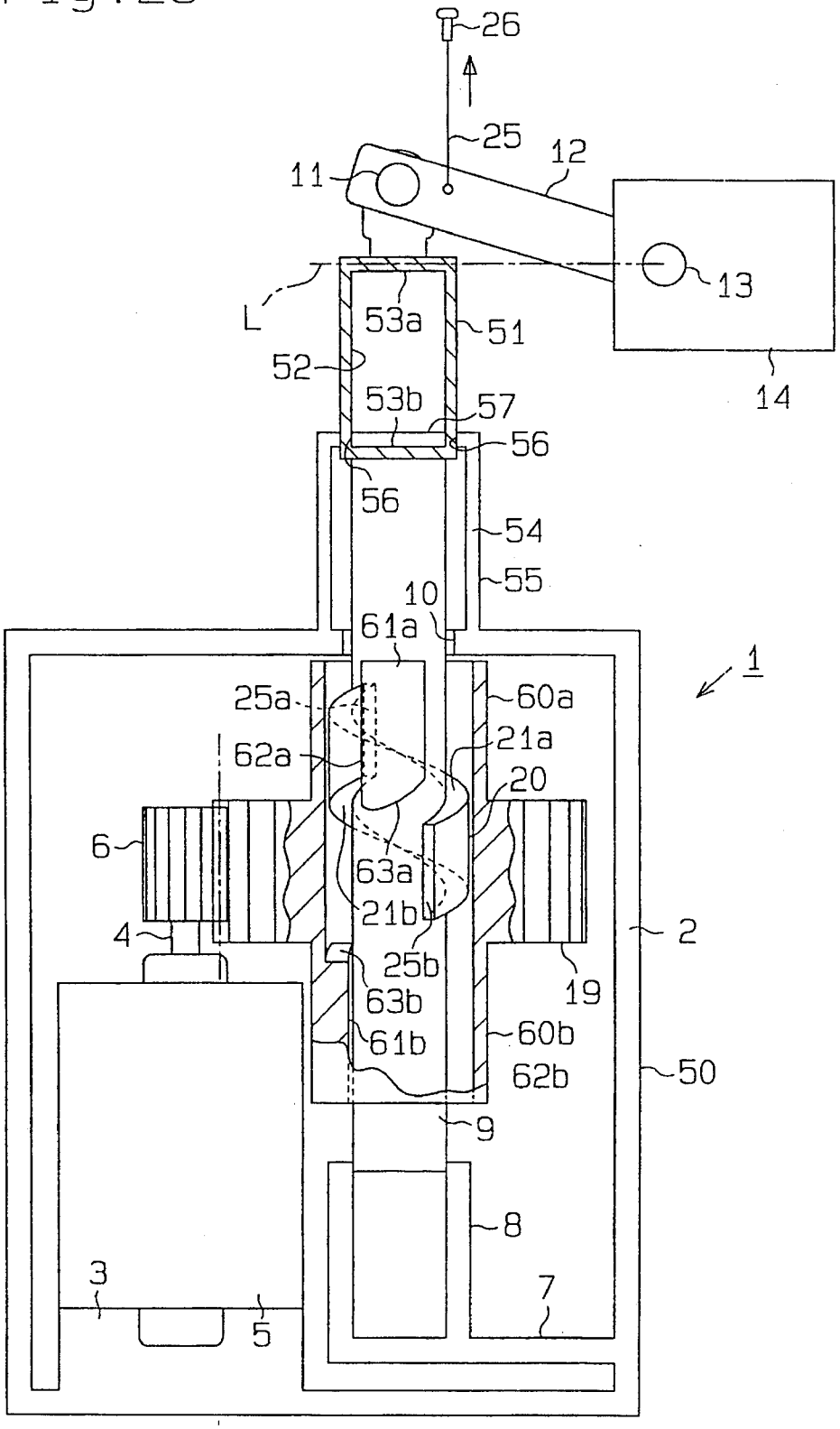

With the arrangement as shown in FIG. 26, even when the rotary gear 19 is rotated clockwise by the drive of the motor 5, the contact-sliding portion 63*b* of the second guide pin 61*b* is kept at the start of rotation away from contact with the second guide surface 21*b* of the guiding member 20. When the rotary gear 19 is rotated clockwise to some extent, the contact-sliding portion 63*b* comes into contact with the second guide surface 21*b* and thereafter slides along the same. As the contact-sliding portion 63*b* of the second guide pin 61*b* slides along the second guide surface 21*b*, the plunger 9 is protruded upward from the casing 2, as shown in FIG. 28. When the connecting pin 11 is moved up over the horizontal line L, the plunger 9 is urged upward by the action of the spring in the locking device 14, as shown in FIG. 29. Then, the second position regulating surface 53*b* comes into the stroke regulating piece 57 to regulate the upward movement of the plunger 9.

When the plunger 9 is moved up, the second guide surface 21*b* of the guiding member 20 leaves the contact-sliding portion 63*b* of the second guide pin 61*b*. In addition, the guiding member 20 is arranged in such a position that the contact surface 62*a* of the first guide pin 61*a* can come into facial contact with the first regulation surface 25*a* of the guiding member 20. When the rotary gear 19 is further rotated clockwise, the contact surface 62*a* of the first guide pin 61*a* comes into contact with the first regulation surface 25*a* of the guiding member 20 so that the rotation of the rotary gear 19 is regulated. At this time, the activation of the drive motor 5 stops to interrupt the rotation of the rotary gear 19.

Figure 30:
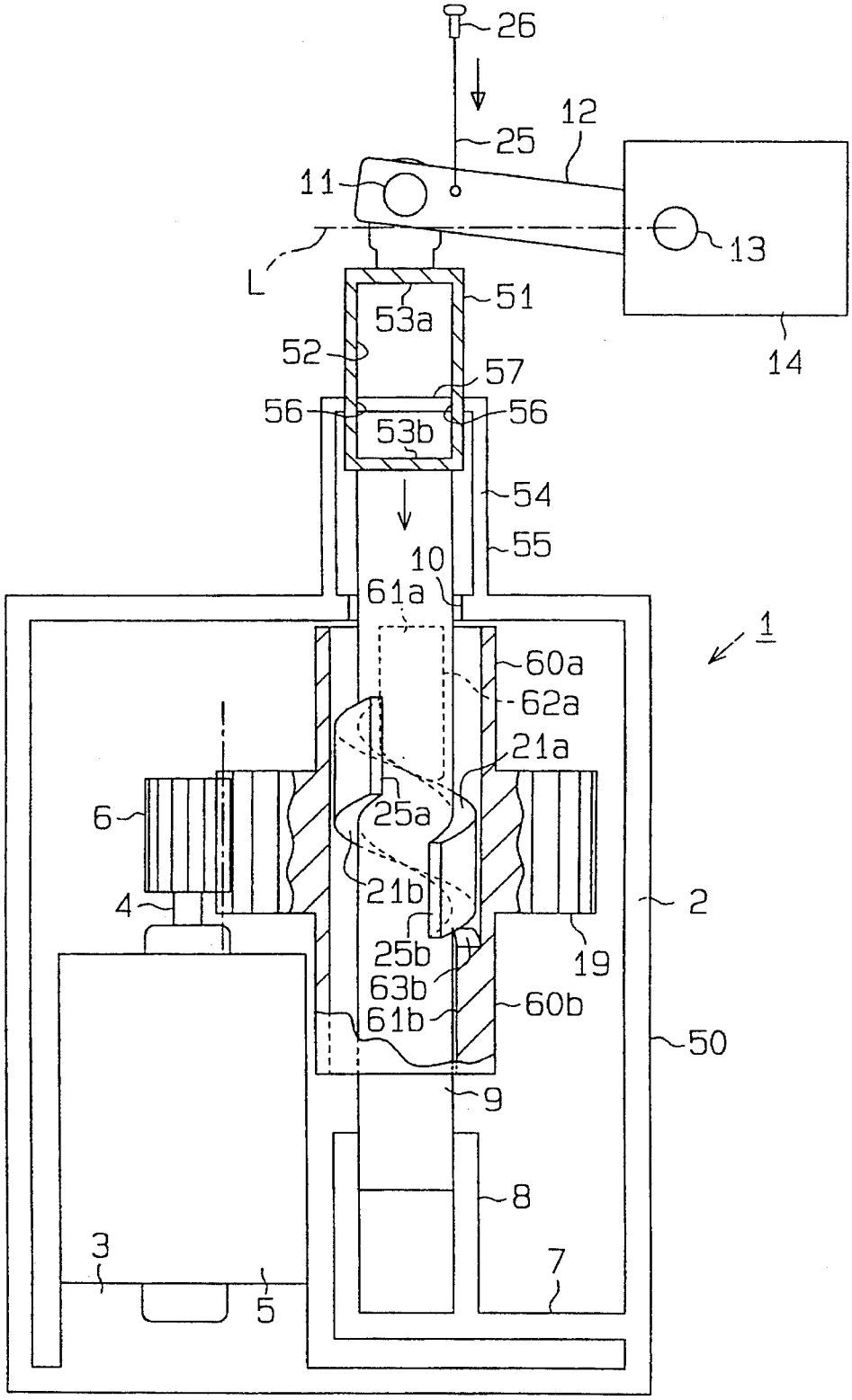

With the arrangement as shown in FIG. 29, when the rotary gear 19 is rotated counter-clockwise, the contact-sliding portion 63*a* of the first guide pin 61*a* is kept at the beginning of the rotation away from contact with the first guide surface 21*a* of the guiding member 20. When the rotary gear 19 is rotated counter-clockwise to some extent, the contact-sliding portion 63*a* comes into contact with the first guide surface 21*a* and slides along the same. As the contact-sliding portion 63*a* slides along the first guide pin 61*a*, the plunger 9 is moved down to intrude the casing 2, as shown in FIG. 30. When the connecting pin 11 is moved down over the horizontal line L, the plunger is pushed down by the action of the spring in the locking device 14, as shown in FIG. 26. Then, the first position regulating surface 53*a* comes into contact with the stroke regulating piece 57, thus regulating the downward movement of the plunger 9.

When the plunger 9 is moved down, the first guide surface 21*a* leaves the contact-sliding portion 63*a* of the first guide pin 61*a*. As a result of the downward movement of the plunger 9, moreover, the guiding member 20 is arranged in such a position that the contact surface 62*b* of the second guide pin 61*b* can come into facial contact with the second guide surface 21*b* of the guiding member 20. When the rotary gear 19 is then further rotated counter-clockwise to bring the contact surface 62*b* of the second guide pin 61*b* into contact with the second regulation surface 25*b* of the guiding member 20, the rotation of the rotary gear 19 is inhibited. At this time, the drive motor 5 stops and interrupts the rotation of the rotary gear 19.

The operations of the electric actuator 1 of this embodiment will be described below. With the arrangement as shown in FIG. 26, the lever 12 is arranged below the horizontal line L, and the plunger 9 is pulled down by the action of the spring in the locking device 14. In this case, the first position regulating surface 53*a* comes into contact with the stroke regulating piece 57 to regulate the retraction of the plunger 9. Moreover, the second regulation surface 25*b* of the guiding member 20 comes into facial contact with the contact surface 62*b* of the second guide pin 61*b* to regulate the counter-clockwise rotation of the rotary gear 19. The locking device 14 is in the lock state, in which the door 101 cannot be opened by the manipulation of the door handle 103.

When the passenger pulls up the knob 26, the plunger 9 is moved up to bring the lever 12 to the position as shown by the double-dotted lines. At this time, the first regulation surface 25*a* of the guiding member 20 has no interference with the guide pin 61*a* so that the plunger 9 can be moved up. Thus, the locking device 14 is switched from the lock state to the unlock state by the manual manipulation of the knob 26.

As the rotary gear 19 is rotated clockwise by the drive of the motor 5, the first and second guide pins 61*a* and 61*b* are also rotated clockwise. In accordance with these rotations, the contact-sliding portion 63*b* of the second guide pin 61*b* slides soon along the second guide surface 21*b*. Then, the second guide pin 61*b* raises the guiding member 20 to protrude the plunger 9 upward from the casing 2, as shown in FIG. 28.

When the connecting pin 11 is moved up over the horizontal line L, the lever 12 is moved to the position as indicated by the solid lines in FIG. 29, by the action of the spring in the locking device 14. At this time, the second position regulating surface 53*b* comes into contact with the stroke regulating piece 57 to regulate the protrusion of the plunger 9. As a result of the protrusion of the plunger 9, on the other hand, the first regulation surface 25*a* of the guiding member 20 is moved upward, and the guiding member 20 is arranged in such a position that the regulation surface 25*a* can come into facial contact with the contact surface 62*a* of the first guide pin 61*a*.

In a short time, the contact surface 62*a* of the first guide pin 61*a* is brought into facial contact with the first regulation surface 25*a* by the rotation of the rotary gear 19, to regulate the rotation of the rotary gear 19. Then, the drive of the motor 5 stops, thus interrupting the rotation of the rotary gear 19. Thus, the locking device 14 comes into the unlock state, in which the door 101 can be opened by the manipulation of the door handle 103. With the arrangement as shown in FIG. 29, when the knob 26 is pushed down, the lever 12 is moved to the position as indicated by the solid lines in FIG. 26, to bring the locking device 14 into the lock state. When the lever 12 is moved to the position of the solid lines of FIG. 26 so that the plunger 9 is retracted into the casing 2, the second regulation surface 25*b* of the guiding member 20 has no interference with the second guide pin 61*b* so that the knob 26 can be pushed down without fail.

As the rotary gear 19 is rotated counter-clockwise from the arrangement shown in FIG. 29 by the drive of the motor 5, the first and second guide pins 61*a* and 61*b* are also rotated counter-clockwise. By these rotations, the contact-sliding portion 63*a* of the first guide pin 61*a* slides soon along the first guide surface 21*a*. Then, the first guide pin 61*a* pushes down the guiding member 20 to retract the plunger 9 into the casing 2, as shown in FIG. 30.

When the connecting pin 11 is moved down over the horizontal line L, the lever 12 is moved to the position as indicated by the solid lines in FIG. 26, by the action of the spring in the locking device 14. At this time, the first position regulating surface 53*a* comes into contact with the stroke regulating piece 57 to regulate the retraction of the plunger 9. As a result of the retraction of the plunger 9, the second regulation surface 25*b* of the guiding member 20 is moved down, and the guiding member 20 is arranged in such a position that the regulation surface 25*b* can come into facial contact with the contact surface 62*b* of the guide pin 61*b*.

As the rotary gear 19 rotates, the contact surface 62*b* of the second guide pin 61*b* comes into facial contact with the second regulation surface 25*b* to regulate the rotation of the rotary gear 19. At this time, the drive of the motor 5 stops, thus interrupting the rotation of the rotary gear 19. Thus, the locking device 14 comes into the lock state, in which the door 101 cannot be opened by the manipulation of the door handle 103.

Figure 31:
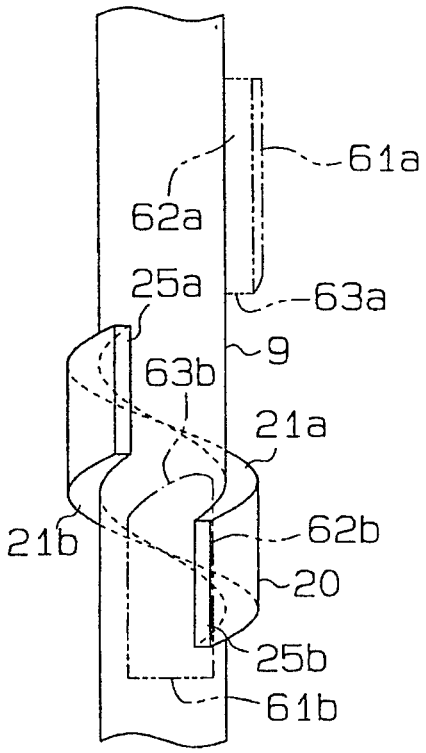
Figure 32:
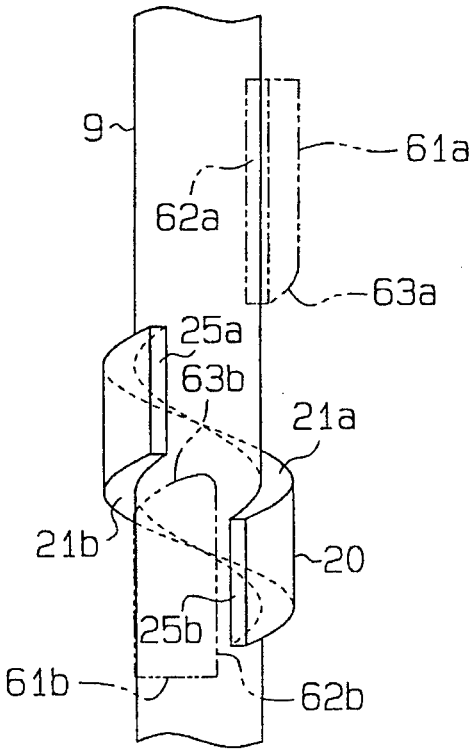
Figure 33:
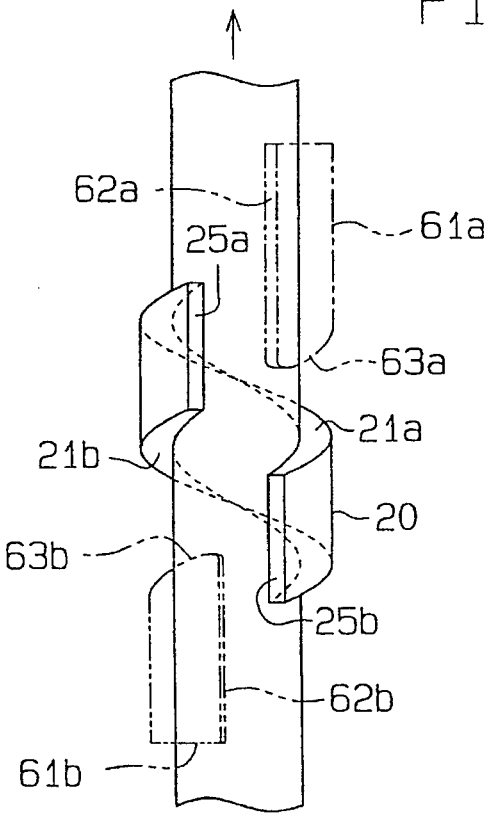

After the contact surface 62*b* of the second guide pin 61*b* has come into facial contact with the second regulation surface 25*b* of the guiding member 20, as shown in FIG. 31, the rotary gear 19 stops. Let it be assumed that the rotary gear 19 be slightly returned clockwise by the impact of the facial contact between the contact surface 62*b* and the regulation surface 25*b* to separate the contact surface 62*b* and the regulation surface 25*b* slightly from each other, as shown in FIG. 32. At this time, the guide pin 61*a* is also rotated clockwise to an extent corresponding to the slight separation.

Since the gap G is retained in advance between the first guide pin 61*a* and the second guide pin 61*b*, however, the upper guide pin 61*a* would not collide against that tip portion of the guiding member 20 having the first regulation surface 25*a* even if the plunger 9 were pulled up with the arrangement as shown in FIG. 32. This discussion likewise applies to the case in which the plunger 9 is pushed down where the contact surface 62*a* of the first guide pin 61*a* slightly leaves the first regulation surface 25*a* of the guiding member 20. In that case, too, the second guide pin 61*b* will not collide against that tip portion of the guiding member 20 having the second regulation surface 25*b*. Consequently, according to this embodiment, the plunger 9 can be pulled up or pushed down without fail by the manual manipulation of the knob 26 so that the locking device 14 can be manually switched between the lock state and the unlock state.

Figure 35:
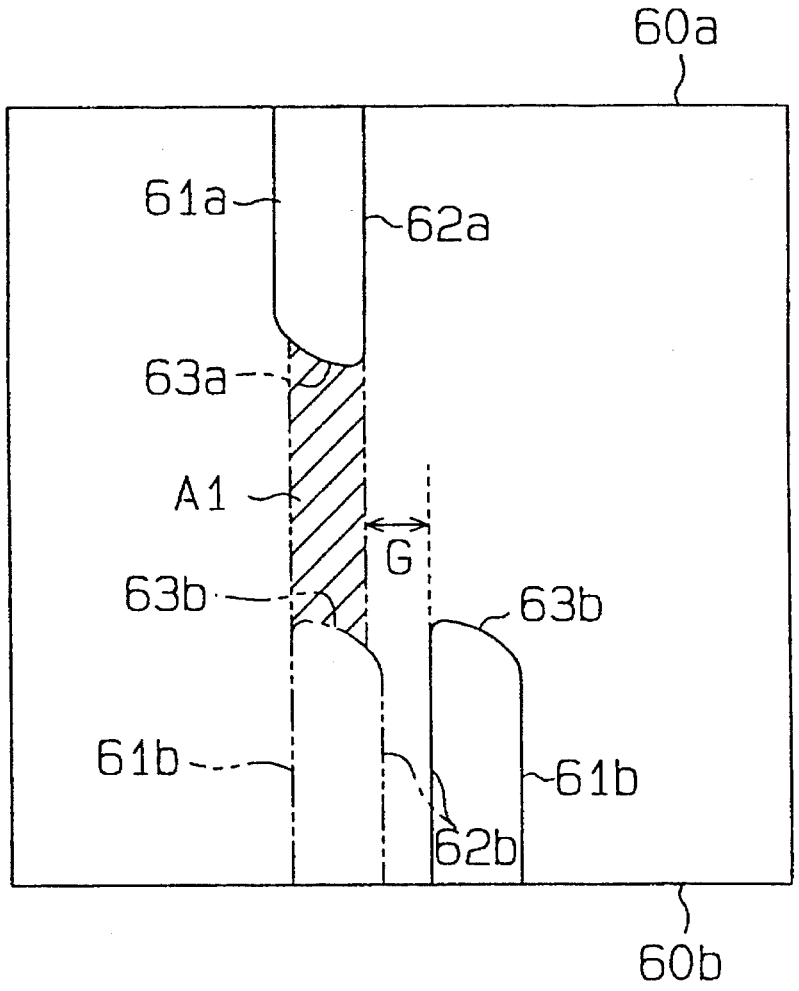

FIG. 35 is an expansion showing the support sleeves 60*a* and 60*b*. If the lower guide pin 61 is arranged in the position as indicated by the double-dotted lines, a hatched area A1 is formed between the upper and lower guide pins 61*a* and 61*b*. In case such support sleeves 60*a* and 60*b* are molded, the upper guide pin 61*a*, the lower guide pin 61*b* and the block filling the area A1 have to be once formed, and then the block of the area A1 has to be cut away. In other words, the internal shape of the support sleeves cannot be formed by a single molding step in case the upper and lower guide pins 61*a* and 61*b* are opposed to each other.

In this embodiment, however, the lower guide pin 61*b* is located on the inner circumference of the sleeve with a displacement of the gap G from the upper guide pin 61*a*. This makes it possible to prepare such a mold as can part the sleeves from the inside after the sleeves have been molded. As a result, the two guide pins 61*a* and 61*b* can be integrally formed on the inner circumference of the support sleeves 60*a* and 60*b* simultaneously with the process for molding the support sleeves 60*a* and 60*b*. Additionally, the guiding member 20 is designed to make an incomplete surrounding around the plunger 9, so that the plunger 9 can be produced by a single molding process while forming the guiding member 20 integrally.

According to this fourth embodiment, only one of the first and second guide pin 61*a* and 61*b* contacts with or slides on the guiding member 20. Like the first to third embodiments, therefore, the loads to be borne by the individual guide pins 61*a* and 61*b* are approximately one half as large as that of the pins of conventional actuators, so that the lifetimes of the guide pins 61*a* and 61*b* can be more elongated than those of the pins of conventional actuators.

Since the guide pins 61*a* and 61*b* are formed integrally with the support sleeves 60*a* and 60*b*, the shock resistance of the pins 61*a* and 61*b* is improved in the case where the guide pins 61*a* and 61*b* come into collision against the regulation surfaces 25*a* and 25*b*.

Since the individual contact-sliding portions 63*a* and 63*b* of the guide pins 61*a* and 61*b* to contact with the first and second guide surfaces 21*a* and 21*b* are curved, the guide pins 61*a* and 61*b* come into line-contact with the first and second guide surfaces 21*a* and 21*b*. This smoothens the sliding motions of the guide pins on the guide surfaces.

Moreover, since the guide pins 61*a* and 61*b* come into facial contact with the regulation surfaces 25*a* and 25*b* of the guiding member 20, the shocks to be received by the guide pins 61*a* and 61*b* are dispersed all over the associated contacting surfaces. This prevents the guide pins 61*a* and 61*b* from being partially worn, resulting in the improvement of the durability of the guide pins 61*a* and 61*b*.

While one guide pin (61*a* or 61*b*) is in contact with its associated regulation surface (25*a* or 25*b*), the other guide pin is spaded from its associated guide surface (21*a* or 21*b*). When the rotary gear 19 is rotated to some extent, that other guide pin comes into contact with its associated guide surface. Accordingly, even if the plunger 9 is assembled with the lever 12 with a slight displacement from a predetermined position, no mutual interference occurs between the guide pins and the guiding member. Thus, the actuator of this embodiment can be reliably prevented from the inoperative state which might otherwise be caused by the assembly error.

Although the casing 2, the pinion 6, the plunger 9, the guiding member 20, the rotary gear 19, the support sleeves 60*a* and 60*b* and the guide pins 61*a* and 61*b* are made of resins in order to reduce the weight of the actuator 1, they may be made of metals, if necessary. The guide pins 61*a* and 61*b* may be produced separate from the support sleeves 60*a* and 60*b*. The guiding member 20 may also be produced separate from the plunger 9.

Fifth Embodiment

Figure 36:
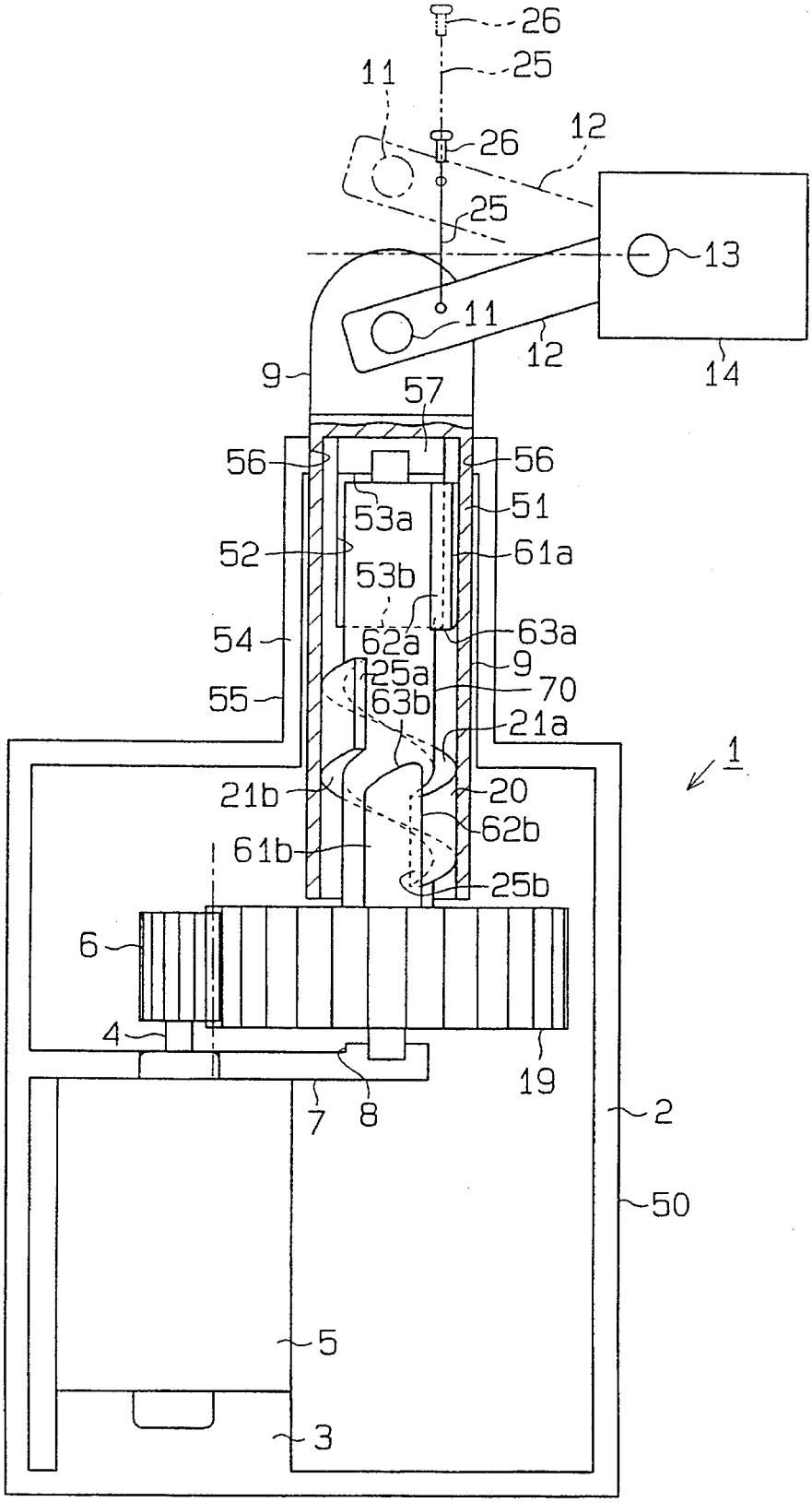
Figure 37:
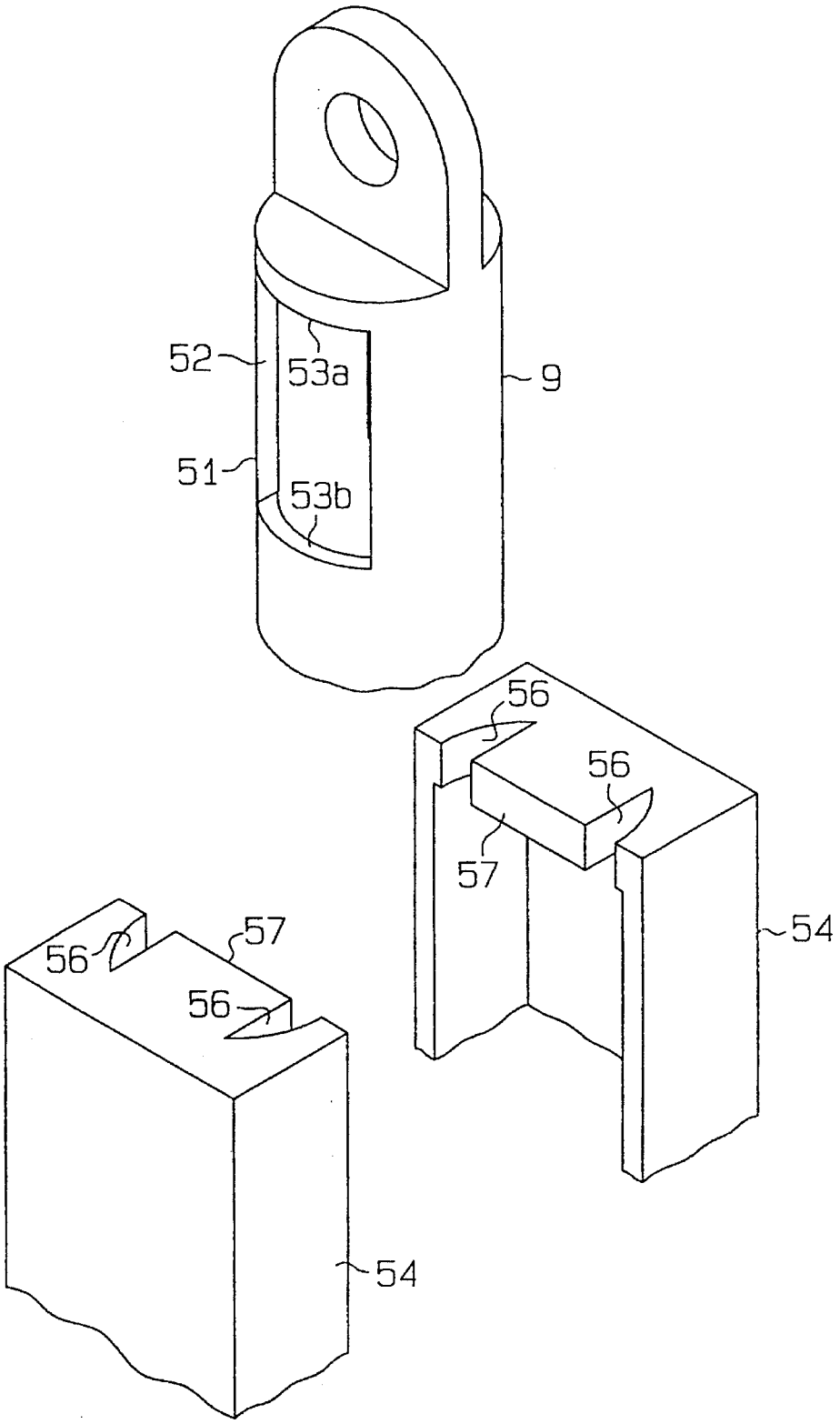
Figure 40:
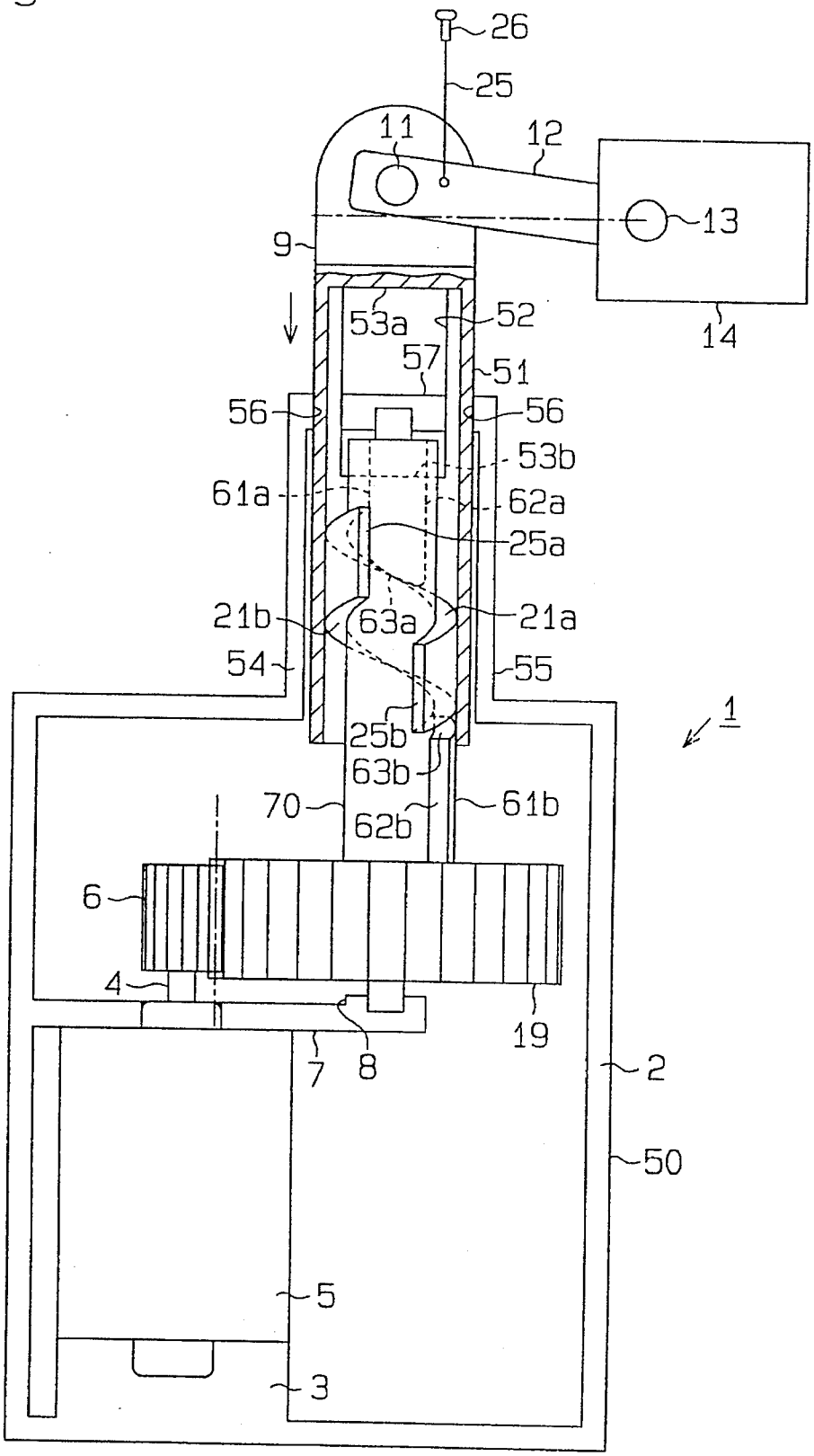
Figure 41:
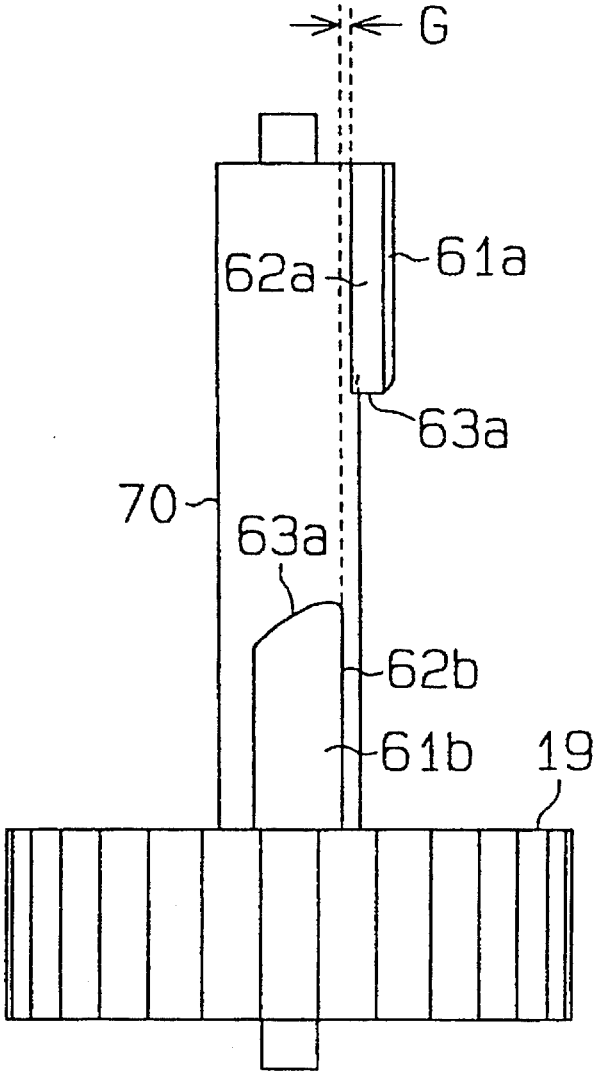

A fifth embodiment, which is a modification of the fourth embodiment, will be described with reference to FIGS. 36 to 41. As shown in FIG. 36, a resinous plunger 9 is hollowly formed, and has a guiding member 20 as a leading member formed on its lower inner wall integrally with the plunger 9. A resinous rotary shaft 70 is formed integrally with the rotary gear 19, at the center of the gear 19. The rotary shaft 70 has its top end rotatably received by the stroke regulating piece 57 and its bottom end rotatably received by a small sleeve portion 8 formed on a support wall 7. As shown in FIGS. 36 and 41, a first and second guide pins 61*a* and 61*b* as a first and second movement guiding members are formed integrally with the rotary shaft 70, on the outer circumference of the shaft, like the fourth embodiment.

With the arrangement as shown in FIG. 36, the locking device 14 is in the lock state, in which the door 101 cannot be opened by the manipulation of the door handle 103. When the knob 26 is pulled up, the lever 12 is moved to the position as indicated by the double-dotted lines, and the plunger 9 is moved upward. At this time, the locking device 14 is in the unlock state, in which the door 101 can be opened by the manipulation of the door handle 103.

Figure 38:
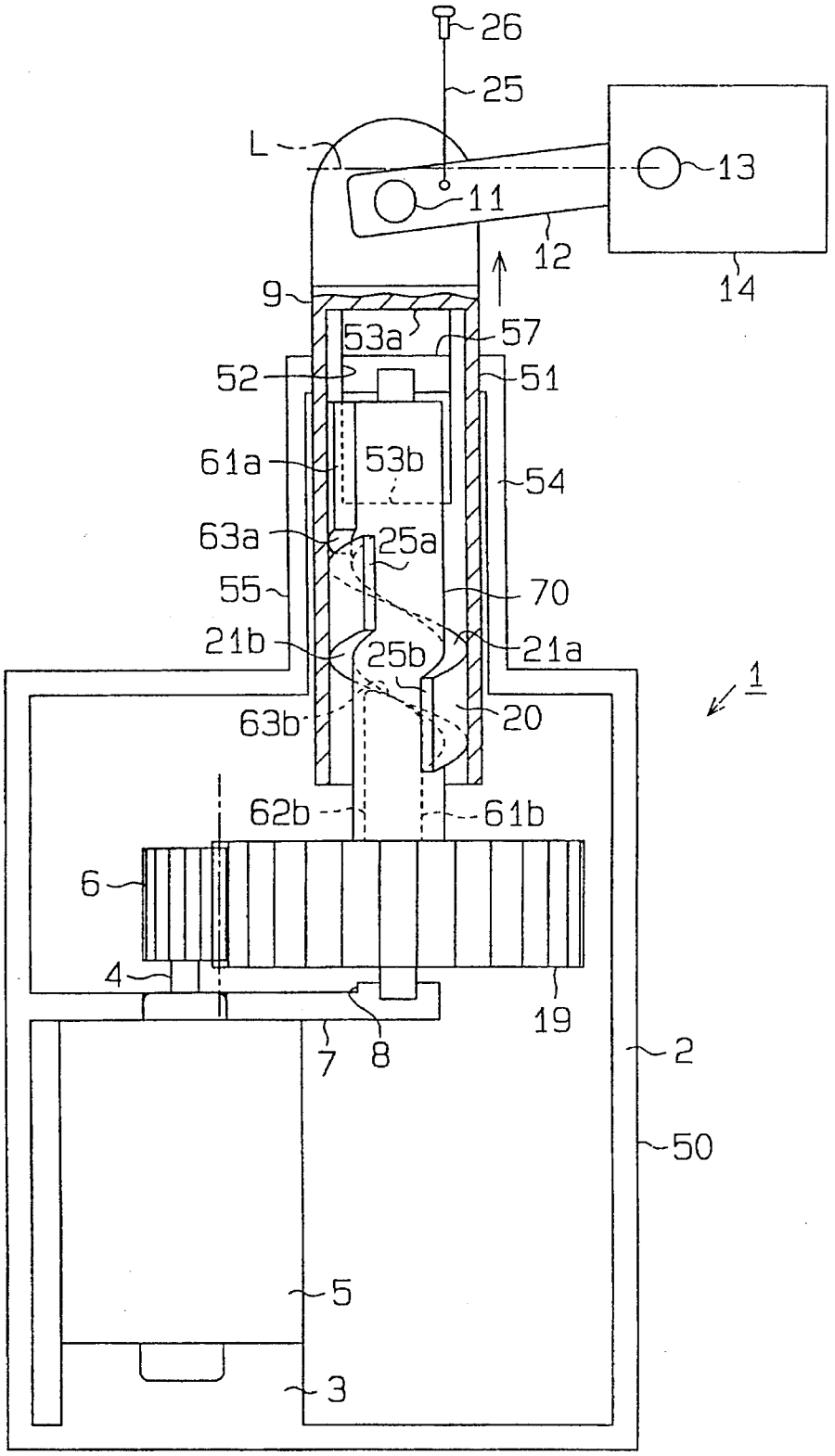

With the arrangement as shown in FIG. 36, even when the rotary gear 19 and the rotary shaft 70 are rotated clockwise by the drive of the motor 5, the contact-sliding portion 63*b* of the lower guide pin 61*b* is kept at an initial stage away from contact with the second guide surface 21*b* of the guiding member 20. When the rotary shaft 70 is rotated to some extent, the lower guide pin 61*b* slides along the second guide surface 21*b*. In accordance with this sliding, the lower guide pin 61*b* pushes the second guide surface 21*b* to move the plunger 9 upward, as shown in FIG. 38.

Figure 39:
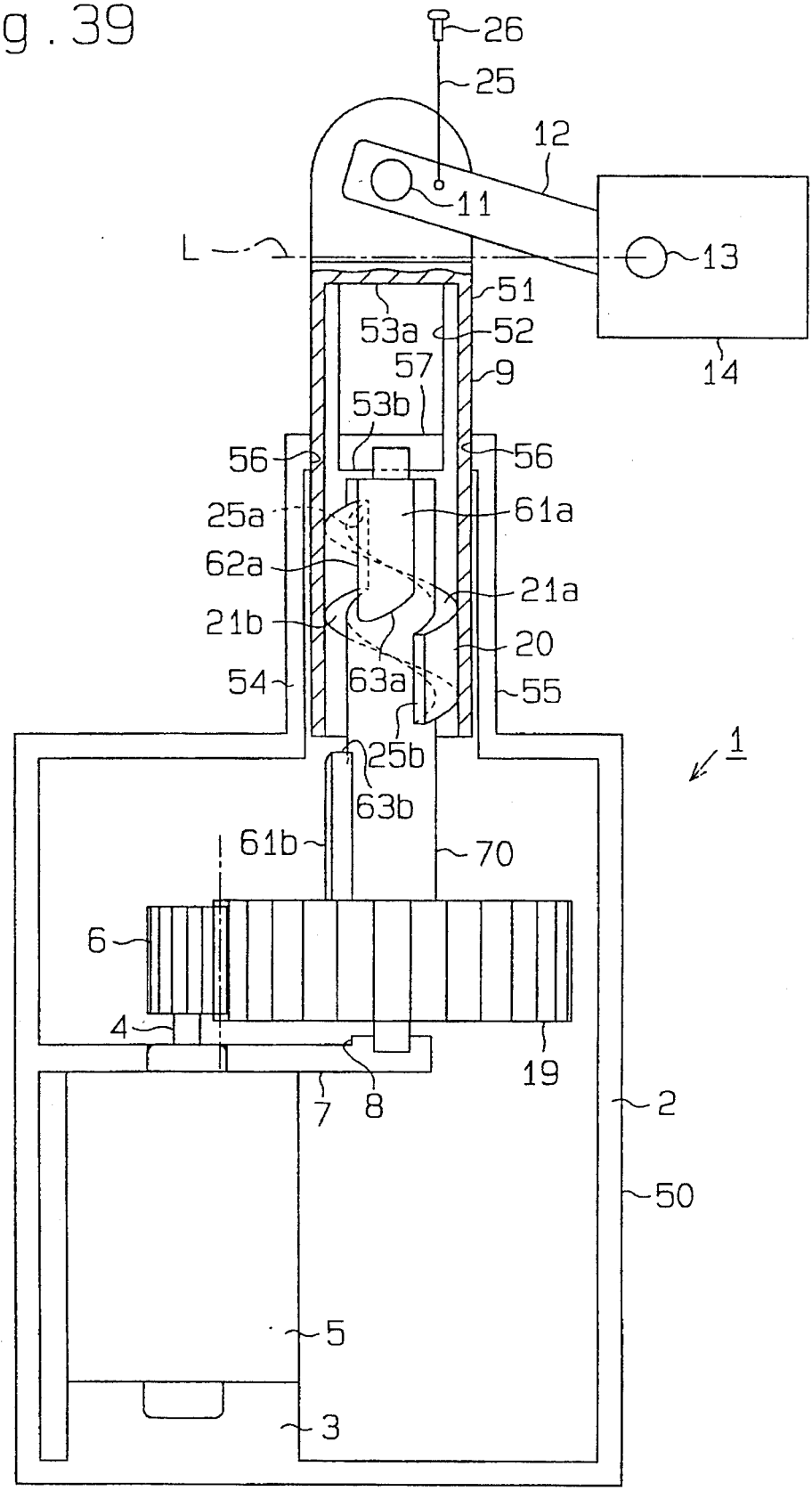

When the connecting pin 11 is located above the horizontal line L, the plunger 9 is raised up to the uppermost position shown in FIG. 39 by the action of the spring (not shown) in the locking device 14. Then, the second position regulating surface 53*b* formed on the plunger 9 comes into contact with the stroke regulating piece 57 to regulate the protrusion of the plunger 9. When the rotary shaft 70 is further rotated clockwise, the contact surface 62*a* of the upper guide pin 61*a* comes into contact with the first regulation surface 25*a*, thereby regulating the rotation of the rotary shaft 70. At this time, the drive of the motor 5 stops to interrupt the rotation of the rotary shaft 70. When the knob 26 is pushed down by a passenger, the plunger 9 is moved down into the casing 2, so that the lever 12 is moved to the position as indicated by the solid lines in FIG. 36. At this time, the locking device 14 takes the lock state.

With the arrangement as shown in FIG. 36, even when the rotary gear 19 and the rotary shaft 70 are rotated counter-clockwise, the contact-sliding portion 63*a* of the upper guide pin 61*a* is kept at an initial stage away from contact with the first guide surface 21*a*. When the rotary shaft 70 is rotated to some extent, the upper guide pin 61*a* slides along the first guide surface 21*a*. In accordance with this sliding, the upper guide pin 61*a* pushes the first guide surface 21*a* to move the plunger 9 downward, as shown in FIG. 40.

When the connecting pin 11 is moved down over the horizontal line L, the plunger 9 is pulled down by the spring in the locking device 14. As shown in FIG. 36, the first position regulating surface 53*a* formed on the plunger 9 comes into contact with the stroke regulating piece 57 to regulate the retraction of the plunger 9. When the rotary shaft 70 is further rotated counter-clockwise, the second regulation surface 25*b* of the guiding member 20 comes into contact with the contact surface 62*b* of the lower guide pin 61*b*, regulating the rotation of the rotary shaft 70. At this time, the drive of the motor 5 stops to interrupt the rotation of the rotary shaft 70. When the knob 26 is pulled up by the passenger, the plunger 9 is moved up so that the lever 12 is moved to the position as indicated by the double-dotted lines in FIG. 36. At this time, the locking device 14 comes into the unlock state.

The two guide pins 61*a* and 61*b* are formed, as in the fourth embodiment, on the rotary shaft 70 at a circumferential spacing of the gap G. As a result, even when the guide pin 61*a* or 61*b* is not in close contact with the regulation surface 25*a* or 25*b* of the guiding member 20, the plunger 9 can be moved up and down by the manual manipulation of the knob 26, like the fourth embodiment.

According to this embodiment, even when the rotary gear 19, the rotary shaft 70 and the guide pins 61*a* and 61*b* are rotated, only one of the guide pins 61*a* and 61*b* comes into contact with the guiding member 20. Accordingly, the loads to be borne by the individual guide pins 61*a* and 61*b* are approximately one half as large as those of the pins of conventional actuators, so that the lifetimes of the guide pins 61*a* and 61*b* can be more elongated than those of the conventional actuators.

Since the contact-sliding portions 63*a* and 63*b* of the guide pins 61*a* and 61*b* are curved, the guide pins 61*a* and 61*b* come into line-contact with the first and second guide surfaces 21*a* and 21*b*. This smoothens the sliding motions of the guide pins 21*a* and 21*b*.

Like the foregoing fourth embodiment, moreover, the actuator of this embodiment has the advantages that the guide pins 61*a* and 61*b* are in facial contact with the regulation surfaces 25*a* and 25*b* of the guiding member 20 and that the actuator is not made inoperative by the assembly error.

Although the casing 2, the pinion 6, the plunger 9, the guiding member 20, the rotary gear 19, the rotary shaft 70, and the guide pins 61*a* and 61*b* are made of resins in order to reduce the weight of the actuator 1, they may be made of metals, if necessary. The plunger 9 and the guiding member 20 also be produced separate from each other.

Sixth Embodiment

A sixth embodiment of the present invention will be described with reference to FIGS. 42 to 48. The parts common to those of the foregoing first to fifth embodiments are designated at the identical reference numerals, and their detailed description will be omitted.

Figure 42:
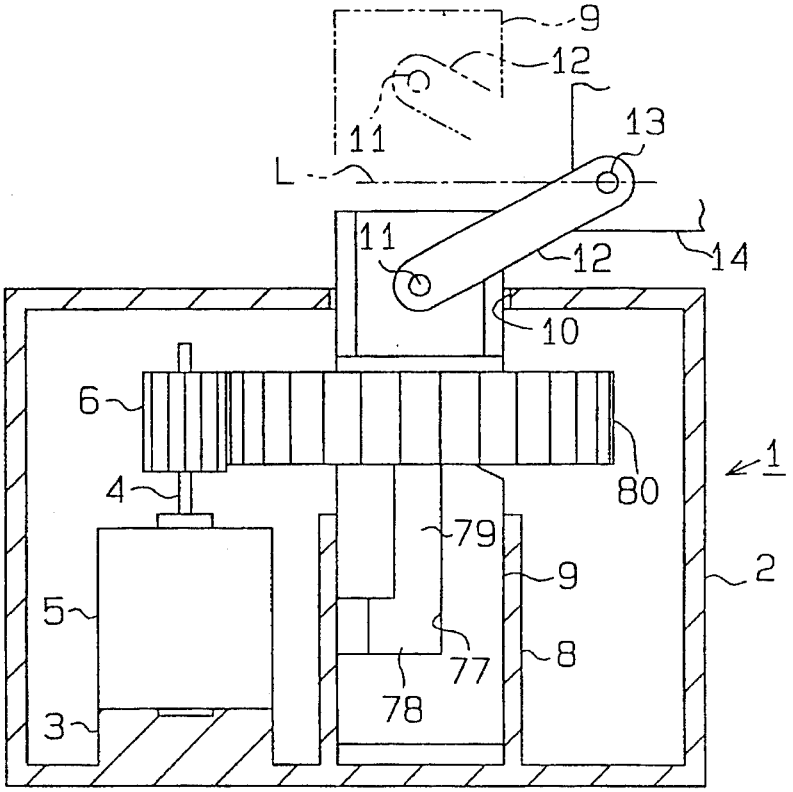
Figure 43:
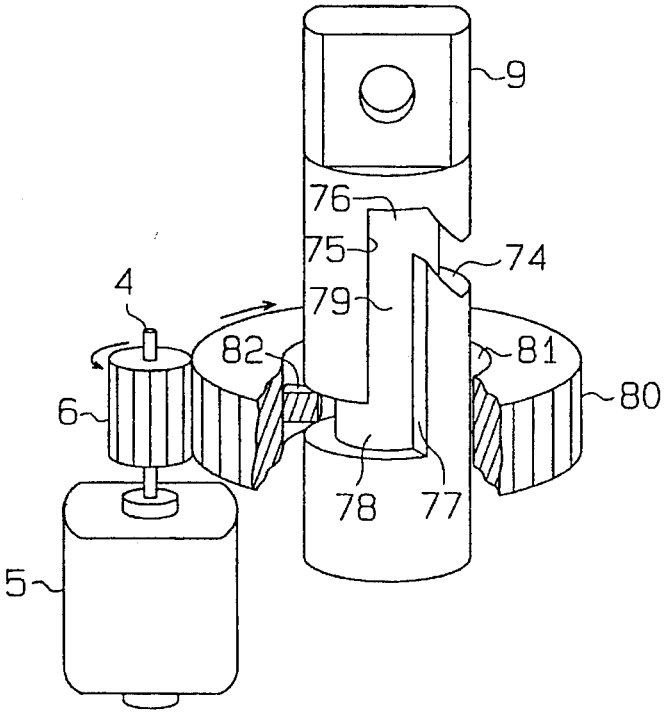
Figure 44:
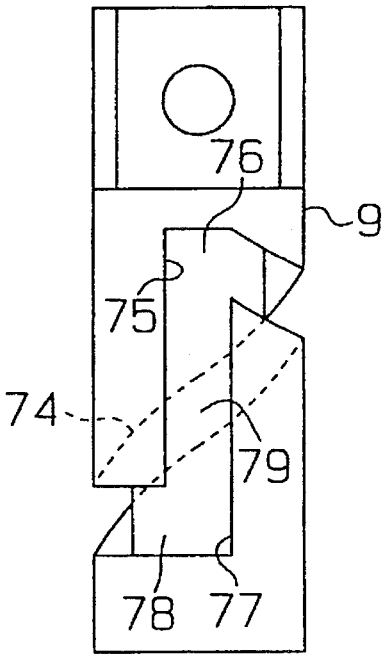

As shown in FIG. 42, a drive motor 5 is mounted on a bed 3 of a casing 2 of an electric actuator 1. A pinion 6 is fixed on a drive shaft 4 of the motor 5. A bottom end of the plunger 9 is received by a sleeve portion 8 formed on the bottom wall of the casing 2 such that the plunger 9 is vertically movable. A top end of the plunger 9 is protruded upward through a bore 10 formed in the upper wall of the casing 2.

The top end of the plunger 9 is connected to a distal end of the lever 12, via a connecting pin 11. The lever 12 has a proximal end connected to the locking device 14 via a pivot 13. When the plunger 9 is protruded from the casing 2 so that the lever 12 goes up over the horizontal line L extending through the pivot 13, the plunger 9 and the lever 12 are moved to the uppermost position as indicated by the double-dotted lines, by the action of the spring (not shown) in the locking device 14. At this time, the locking device 14 takes the unlock state. On the other hand, when the plunger 9 is retracted into the casing 2 so that the lever 2 goes down over the horizontal line L, the plunger 9 and the lever 12 are moved to the lowermost position as indicated by the solid lines, by the action of the spring in the locking device 14. At this time, the locking device 14 takes the lock state.

The plunger 9 has a spiral guide groove 74 formed on its circumferential wall, and a connecting groove 79 extending in the axial direction of the plunger 9 and connecting the upper and lower end portions of the guide groove 74. A first regulation surface 75 is formed at the upper end portion of the guide groove 74, the upper portion serving as a first regulation position 76. A second regulation surface 77 is formed at the lower end portion of the guide groove 74, the lower portion serving as a second regulation position 78.

Figure 45:
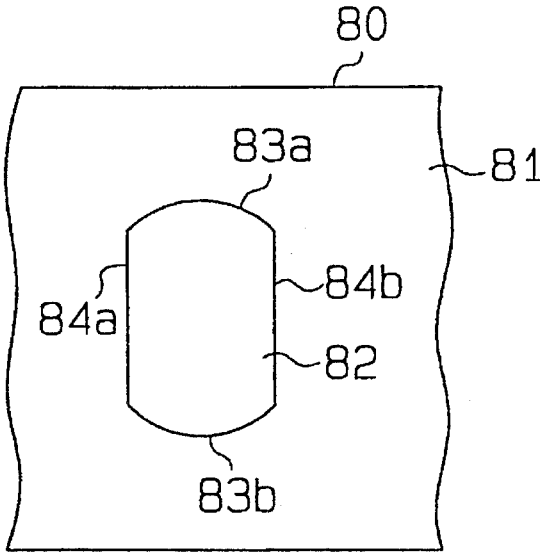

A rotary gear 80, engaged with the pinion 6, has a bore 81 formed in its center, for receiving the plunger 9. A guide pin 82 is formed on an inner circumference of the gear 80 integrally with the gear 80, and serves as a guide member to engage with the guide groove 74. The rotary gear 80 is supported on the plunger 9, by means of the engagement of the guide pin 82 with the guide groove 74. As shown in FIG. 45, the guide pin 82 has arcuate contact-sliding portions 83*a* and 83*b* formed on its upper and lower portions, and straight contact surfaces 84*a* and 84*b* formed on its right and lefthand sides.

Figure 47:
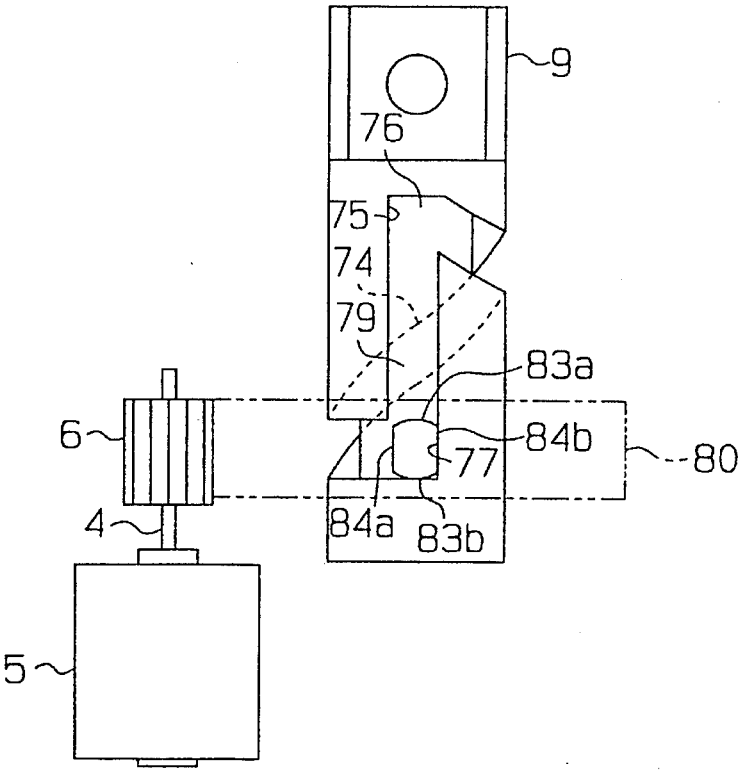

With the arrangement as shown in FIG. 47, when the rotary gear 80 is rotated clockwise by the drive of the motor 5 for a predetermined period of time, the guide pin 82 is slid along the guide groove 74. Since the plunger 9 is urged upward by the action of the spring in the locking device 14, the lower contact-sliding portion 83*b* of the guide pin 82 is pressed against the lower inner wall of the guide groove 74.

Figure 46:
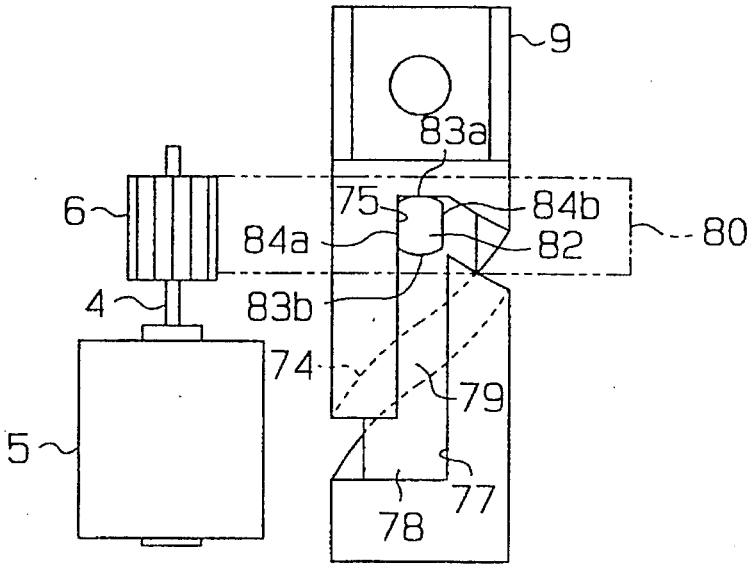

In accordance with the clockwise rotation of the rotary gear 80, the plunger 9 is moved down so that it is gradually retracted into the casing 2. When the lever 12 is located below the horizontal line L by the downward movement of the plunger 9, the upper contact-sliding portion 83*a* of the guide pin 82 is pressed against the upper inner wall of the guide groove 74 by the action of the spring in the locking device 14. Thereafter when the contact surface 84*a* of the guide pin 82 comes into contact with the first regulation surface 75 to regulate the downward movement of the guide pin 82, as shown in FIG. 46, the rotation of the rotary gear 80 is regulated to interrupt the drive of the motor 5. Then, the guide pin 82 is located in the first regulation position 76 to regulate any further downward movement of the plunger 9 so that the plunger 9 is retracted into the casing 2. Moreover, the locking device 14 takes the lock state.

With the arrangement as shown in FIG. 46, when the rotary gear 80 is rotated counter-clockwise by the drive of the motor 5 for a predetermined period of time, the guide pin 82 is slid along the guide groove 74. At this time, since the plunger 9 is urged downward by the action of the spring in the locking device 14, the upper contact-sliding portion 83*a* of the guide pin 82 is pressed against the upper inner wall of the guide groove 74.

In accordance with the counter-clockwise rotation of the rotary gear 80, the plunger 9 is moved up so that it is gradually protruded from the casing 2. When the lever 12 is located above the horizontal line L, the lower contact-sliding portion 83*b* of the guide pin 82 is pressed against the lower inner wall of the guide groove 74 by the action of the spring in the locking device 14. When the contact surface 84*b* of the guide pin 82 comes into contact with the second regulation surface 77, as shown in FIG. 47, the rotation of the rotary gear 80 is regulated to interrupt the drive of the motor 5. At this time, the guide pin 82 is located in the second regulation position 78 to regulate any further upward movement of the plunger 9, so that the plunger 9 is protruded out of the casing 2. Moreover, the locking device 14 takes the unlock state.

When the plunger 9 is moved up and down with the guide pin 82 being positioned in the first or second regulation position 76 or 78, the guide pin 82 can be switched, via the connecting groove 79, between the first and second regulation positions 76 and 78. Accordingly, the locking device 14 can be brought into the lock or unlock state, by the manual manipulation of the knob 106 for door locking. Since, in this case, the guide pin 82 located at the first regulation position 76 can be moved to the second regulation position 78 via the connecting groove 79, the plunger 9 can be manually protruded out of the casing 2. On the other hand, since the guide pin 82 located at the second regulation position 78 can be moved to the first regulation position 76 via the connecting groove 79, the plunger 9 can be manually retracted into the casing 2.

The operations of the actuator 1 of this embodiment will be described below. While the plunger 9 is retracted in the casing 2, as shown in FIG. 46, the lever 12 is located below the horizontal line L so that the locking device 14 is in the lock state. At this time, the plunger 9 is located at the lowermost position via the lever 12 by the action of the coil spring in the locking device 14. Accordingly, the guide pin 82 is positioned in the first regulation position 76, and the contact surface 84*a* of the guide pin 82 is in contact with the first regulation surface 75 whereas the contact-sliding portion 83*a* is in contact with the upper inner surface of the guide groove 74.

As the rotary gear 80 is rotated counter-clockwise, the guide pin 82 moves along the guide groove 74. In accordance with the movement of the pin 82, the plunger 9 is moved up. when the lever 12 is located above the horizontal line L, the plunger 9 is pulled up by the action of the spring in the locking device 14. As a result, the lower contact-sliding portion 83*b* of the guide pin 82 comes into contact with the lower inner surface of the guide groove 74. When the contact surface 84*b* of the guide pin 82 comes into contact with the second regulation surface 77 so that the guide pin 82 is located at the second regulation position 78, as shown in FIG. 47, the drive motor 5 stops. When the plunger 9 is located at the uppermost position, the locking device 14 takes the unlock state.

With the arrangement as shown in FIG. 47, as the rotary gear 80 is rotated clockwise so that the guide pin 82 moves along the guide groove 74, the plunger 9 moves down. When the lever 12 is located below the horizontal line L, the plunger 9 is pulled down by the action of the spring in the locking device 14. Then, the upper contact-sliding portion 83*a* of the guide pin 82 comes into contact with the upper inner surface of the guide groove 74. When the contact surface 84*a* of the guide pin 82 comes into contact with the first regulation surface 75 so that the guide pin 82 is located at the first regulation position 76, as shown in FIG. 46, the drive motor 5 stops. Thus, the plunger 9 is located at the lowermost position, and the locking device 14 takes the lock state.

In case the knob 106 is manipulated with the guide pin 82 being positioned in the first regulation position 76 or the second regulation position 78, the connecting groove 79 allows the plunger 9 to vertically move. As a result, the locking device 14 can be controlled by the manual operation of the knob 106.

The provision of the guide groove 74 for the plunger 9 to engage with the guide pin 82 achieves omission of the special construction for supporting the rotary gear 80. As a result, the electric actuator 1 can be made compact.

Since the contact-sliding portions 83*a* and 83*b* of the guide pin 82 are arcuately formed, the sliding resistance of the guide pin 82 to the upper or lower inner surface of the guide groove 74 is reduced, thus smoothening the sliding motions of the guide pin 82 along the guide groove 74. Moreover, the flat contact surfaces 84*a* and 84*b*, formed on the right and left sides of the guide pin 82, damp the shocks which are caused when the guide pin 82 contacts with the first or second regulation surface 75 or 77.

In this embodiment, the stroke of vertical movement of the plunger 9 can be adjusted by changing the lead angle and/or length of the guide groove 74.

Figure 48:
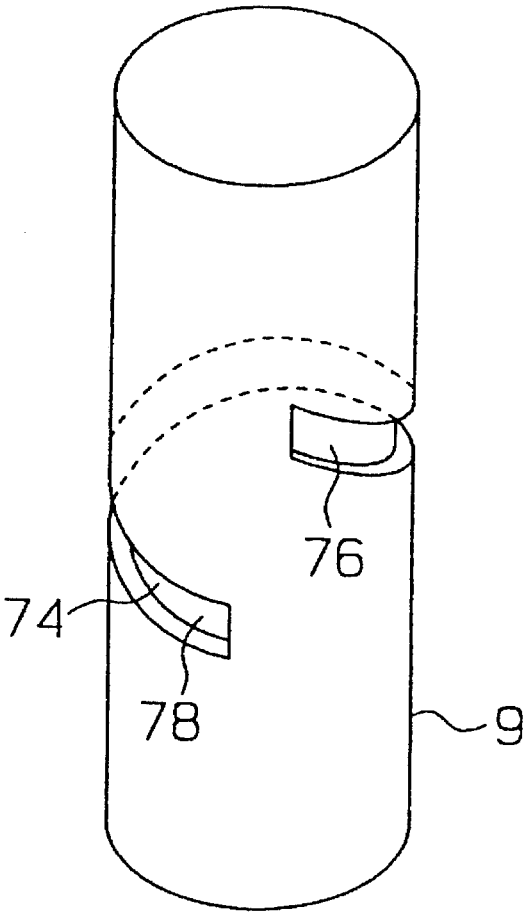

If the manual manipulation of the plunger 9 is not required, a spiral guide groove 74 having the first and second regulation positions 76 and 78 may be merely formed on the outer circumference of the plunger 9, as shown in FIG. 48.

Although only six embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. An actuator comprising:

a casing;

a drive motor;

a plunger for reciprocating in its axial direction, a portion of which protrudes outside the actuator;

a rotary member to be rotated clockwise and counter-clockwise by said drive motor, said rotary member including a support sleeve into which said plunger is inserted, said support sleeve having a first and second movement guiding portions formed on its inner circumference; and a spiral leading member fixed on said plunger, wherein said leading member includes:

a first and second spiral guide surfaces capable of contacting with said first and second movement guiding portions, respectively;

a first regulation surface formed at a first tip end of the leading member, for contacting with said first movement guiding portion to regulate the rotation of said rotary member; and a second regulation surface formed at a second tip end of the leading member, for contacting with said second movement guiding portion to regulate the rotation of said rotary member, and wherein said first and second movement guiding portions are disposed on an inner circumference of said support sleeve, in such a manner that said second movement guiding portion has no interference with said second tip end of said leading member even when said plunger reciprocates with said first movement guiding portion being in contact with said first regulation surface of said leading member, and that said first movement guiding portion has no interference with said first tip end of said leading member even when said plunger reciprocates with said second movement guiding portion being in contact with said second regulation surface of said leading member.

2. The actuator according to claim 1, wherein said first movement guiding portion and said second movement guiding portion are arranged apart from each other at a predetermined gap (G) along the circumference of said support sleeve.

3. The actuator according to claim 1 further comprising regulation means, provided in said plunger and said casing, for regulating the reciprocation of said plunger.

4. The actuator according to claim 3, wherein said regulation means includes:

a stroke adjusting part (51) carried on a distal end of said plunger and having a first and second position regulating surfaces (53*a*, 53*b*); and a stroke regulating piece (57) formed in said casing, for contacting with one of said first and second position regulating surfaces (53*a*, 53*b*) to determine the stroke of the reciprocation of said plunger.

5. The actuator according to claim 1, wherein said first movement guiding portion of said support sleeve has a contact-sliding portion for coming into line-contact with said first spiral guide surface of said leading member, and a contact surface for coming into facial contact with said first regulation surface of said leading member; and wherein said second movement guiding portion of said support sleeve has a contact-sliding portion for coming into line-contact with said second spiral guide surface of said leading member; and a contact surface for coming into facial contact with said second regulation surface of said leading member.

* * * * *